US007246874B2

(12) United States Patent
Hirakata et al.

(10) Patent No.: US 7,246,874 B2
(45) Date of Patent: Jul. 24, 2007

(54) MAINTENANCE DEVICE AND RECORDING DEVICE

(75) Inventors: Susumu Hirakata, Kanagawa (JP); Yoshihira Rai, Kanagawa (JP); Nobuhiro Katsuta, Kanagawa (JP); Hiroaki Satoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 286 days.

(21) Appl. No.: 10/892,481

(22) Filed: Jul. 16, 2004

(65) Prior Publication Data

US 2005/0057603 A1 Mar. 17, 2005

(30) Foreign Application Priority Data

Jul. 18, 2003 (JP) ..... 2003-198884

(51) Int. Cl.
*B41J 2/165* (2006.01)

(52) U.S. Cl. ..... 347/29; 347/30

(58) Field of Classification Search ..... 347/29, 347/30, 33, 104, 32
See application file for complete search history.

(56) References Cited

U.S. PATENT DOCUMENTS 5,625,385 A * 4/1997 Suzuki ..... 347/24
6,070,961 A * 6/2000 Premnath et al. ..... 347/30
6,578,945 B2 * 6/2003 Hashi et al. ..... 347/22

FOREIGN PATENT DOCUMENTS

JP A-07-246715 9/1995
JP A-2002-331691 11/2002

* cited by examiner

*Primary Examiner*—Shih-Wen Hsieh
(74) *Attorney, Agent, or Firm*—Morgan, Lewis & Bockius LLP

(57) ABSTRACT

The present invention provides a maintenance device which can suction ink in a short period of time and with a small amount of consumed ink. The maintenance device has a plurality of capping portions disposed so as to face a plurality of unit heads which can discharge liquid drops onto a recording medium; a plurality of small chambers communicating with the plurality of capping portions, respectively; a suction portion suctioning interiors of the small chambers; and a plurality of valve mechanisms independently controlling airtight states of the interiors of the small chambers. The present invention also provides a recording device equipped with this maintenance device.

9 Claims, 18 Drawing Sheets

MAINTENANCE DEVICE AND RECORDING DEVICE

BACKGROUND OF THE INVENTION

1. Field of the Invention

The present invention relates to a maintenance device and a recording device, and in particular, to an inkjet recording device which carries out recording by discharging ink onto a recording medium, and to a recording device which has this function and which is used as an output device of a fax machine, a copier, a printer multi-function device, a work station, or the like, and to a maintenance device which is used in the recording device.

2. Description of the Related Art

In recent years, the increased popularity of color documents in offices has been extraordinary, and various output devices for color documents have been proposed. In particular, an inkjet method, which enables devices to be made compact and which is inexpensive, is used in various output devices.

A recording head used in the inkjet method is structured from an energy generating means, an energy converting means for converting the energy generated by the energy generating means into ink discharging force, ink discharge openings for discharging ink drops by the ink discharging force, and an ink supply route which communicates with the ink discharge openings and supplies ink thereto. Examples of the energy generating means are a means using an electromechanical converter such as a piezo element or the like, a means which heats the ink by an electricity-heat converting element having a heat-generating resistor so as to generate an air bubble and which discharges an ink drop by generating the air bubble, and the like.

In a recording head using an electricity-heat converting element, because the electricity-heat converting element is compact, the ink discharge openings can be disposed at a high density, and in addition, semiconductor integrated circuit fabricating technology can be used as the technology for manufacturing the recording head. Therefore, a recording head having a large number of highly-precise ink discharge openings can be made to be compact, and can be manufactured at a low cost.

However, currently, the technique which is mainly becoming popular is a printing method called serial scanning which carries out printing line-by-line by reciprocatingly moving a recording head while conveying a recording sheet. This method is compact and inexpensive, but has the drawback that, in order to form an image over the entire sheet, the recording head must be scanned plural times and the printing speed is slow. In order to improve the printing speed, the number of scans must be reduced and the recording head must be made longer. The technique which has pushed this to the limit is a non-scanning printing system which carries out printing by a recording head which has the width of a sheet. This printing system is an inkjet recording device having a recording head which corresponds to the width of a recording sheet and at which a large number of discharge openings are lined-up along a length which is substantially the same as the width of the recording sheet. Recording is carried out by the recording sheet moving with respect to the recording head which is fixed.

In this way, an inkjet recording device, which carries out printing by using a non-scanning-type recording head corresponding to the width of sheets while continuously conveying the sheets, has been proposed in order to improve the printing speed and cope with use in the office.

On the other hand, in the inkjet recording device, in order to keep the ink discharging ability good, when printing is not being carried out, discharging of ink drops (dummy jetting), cleaning of the nozzle surfaces (wiping), preventing drying of the ink (capping), and the like by a maintenance device are necessary. Further, when a state in which printing is not carried out continues over a long period of time, viscosity of ink increases due to drying and the nozzles become clogged. Therefore, the old ink within the recording head must be suctioned (vacuumed) out and discarded. Such maintenance operations must be carried out also on the above-described recording head whose width corresponds to that of the sheets.

For example, Japanese Patent Application Laid-Open (JP-A) No. 7-246715 (Patent Document 1) discloses, in a label printer having an inkjet head corresponding to the width of the sheet, a structure having a cap at which is formed an edge portion which can surround the periphery of the discharge openings of the head.

However, when a single cap is provided for a single head in this way, even in a case in which it suffices to suction only one nozzle, all of the nozzles of the one head are suctioned, and the amount of ink consumed during this suction becomes large.

Further, JP-A No. 2002-331691 (Patent Document 2) discloses an inkjet recording device provided with a driving mechanism which reciprocatingly drives, along a recording head, a suction device having a cap. In this structure, because the cap is made to contact and suction only the ink discharge openings which should be suctioned, less ink is consumed during this suction.

However, in the structure of Patent Document 2, when suctioning at plural places is carried out, a long period of time is required for the suctioning operation overall.

SUMMARY OF THE INVENTION

In view of the aforementioned, the present invention provides a maintenance device which can suction ink in a short period of time and with a small amount of consumed ink, and a recording device equipped with this maintenance device.

A maintenance device of a first aspect of the present invention has: a plurality of capping portions disposed to face a plurality of unit heads which can discharge liquid drops onto a recording medium; a plurality of small chambers communicating with the plurality of capping portions, respectively; a suction portion suctioning interiors of the small chambers; and a plurality of valve mechanisms independently controlling airtight states of the interiors of the small chambers.

In this maintenance device, the airtight states of the interiors of the small chambers can be controlled independently by the valve mechanisms. Accordingly, when the interior of the small chamber is suctioned by the suction portion in a state in which the capping portion is fit tightly to the opposing unit head, the interior of the small chamber can be made to be a desired negative pressure. By operation of the valve mechanism, this negative pressure is applied to the capping portion such that ink can be suctioned from the nozzles of the unit head.

The plural capping portions are provided so as to oppose the plural unit heads. Further, because the negative pressures applied to the capping portions can be controlled for each of the capping portions, the suctioning of ink is carried out only on those unit heads which require ink suctioning. It is thereby possible to reduce the amount of ink which is consumed accompanying the suction operation. From this standpoint, it is preferable to provide the unit heads and the capping portions in a one-to-one correspondence. However, for example, a fixed number of unit heads can be grouped together, and a capping portion and a small chamber may be provided for each of the groups.

Because the respective capping portions oppose the unit heads in advance, there is no need to move the capping portions (only raising the capping portions) at the time of suctioning ink, and ink can be suctioned from the plural unit heads in a short period of time.

A second aspect of the present invention is a recording device having: a recording head structured by a plurality of unit heads which can discharge liquid drops onto a recording medium; and the maintenance device of the first aspect which carries out maintenance on the unit heads.

In this recording device, because recording is carried out by the recording head which is structured by plural unit heads, an even wider range can be recorded in a short period of time.

Further, because it is equipped with the maintenance device of the first aspect, if only the unit heads at which clogging has occurred are suctioned, the ink can be suctioned in a short period of time with less ink being consumed at the time when the ink is suctioned.

Note that the "recording medium" which is the object of image recording in the recording device of the present invention includes a wide variety of objects, provided that they are objects onto which the recording device discharges ink drops. Further, patterns of dots on the recording medium, which are obtained by the ink drops adhering to the recording medium, are broadly included in the "image" or "recorded image" obtained by the recording device of the present invention. Accordingly, the recording device of the present invention is not limited to use in recording characters or images onto recording sheets. The recording medium of course includes recording sheets and OHP sheets and the like, but in addition thereto, also includes, for example, substrates on which wiring patterns or the like are formed, and the like. Further, "image" includes not only general images (characters, drawings, photographs, and the like), but also the aforementioned wiring patterns, as well as three-dimensional objects, organic thin films, and the like. The liquid which is discharged is not limited to a color ink. The recording device of the present invention can be applied to general liquid drop jetting devices used for various industrial applications such as, for example, the manufacturing of color filters for displays which is carried out by discharging color ink onto a macromolecule film or glass, the formation of bumps for part packaging which is carried out by discharging solder in a molten state onto a substrate, the formation of EL display panels which is carried out by discharging an organic EL solution onto a substrate, the formation of bumps for electrical packaging which is carried out by discharging solder in a molten state onto a substrate, and the like.

BRIEF DESCRIPTION OF THE DRAWINGS

Embodiments of the invention will be described in detail with reference to the drawings.

FIG. 13A shows an open state, and FIG. 13B shows a closed state;

FIG. 14A shows an open state, and FIG. 14B shows a closed state;

FIG. 15A shows an open state, and FIG. 15B shows a closed state;

DETAILED DESCRIPTION OF THE INVENTION

[Basic Structure]

First, the basic structure of an ink jet recording device of the present invention will be described.

Figure 1:
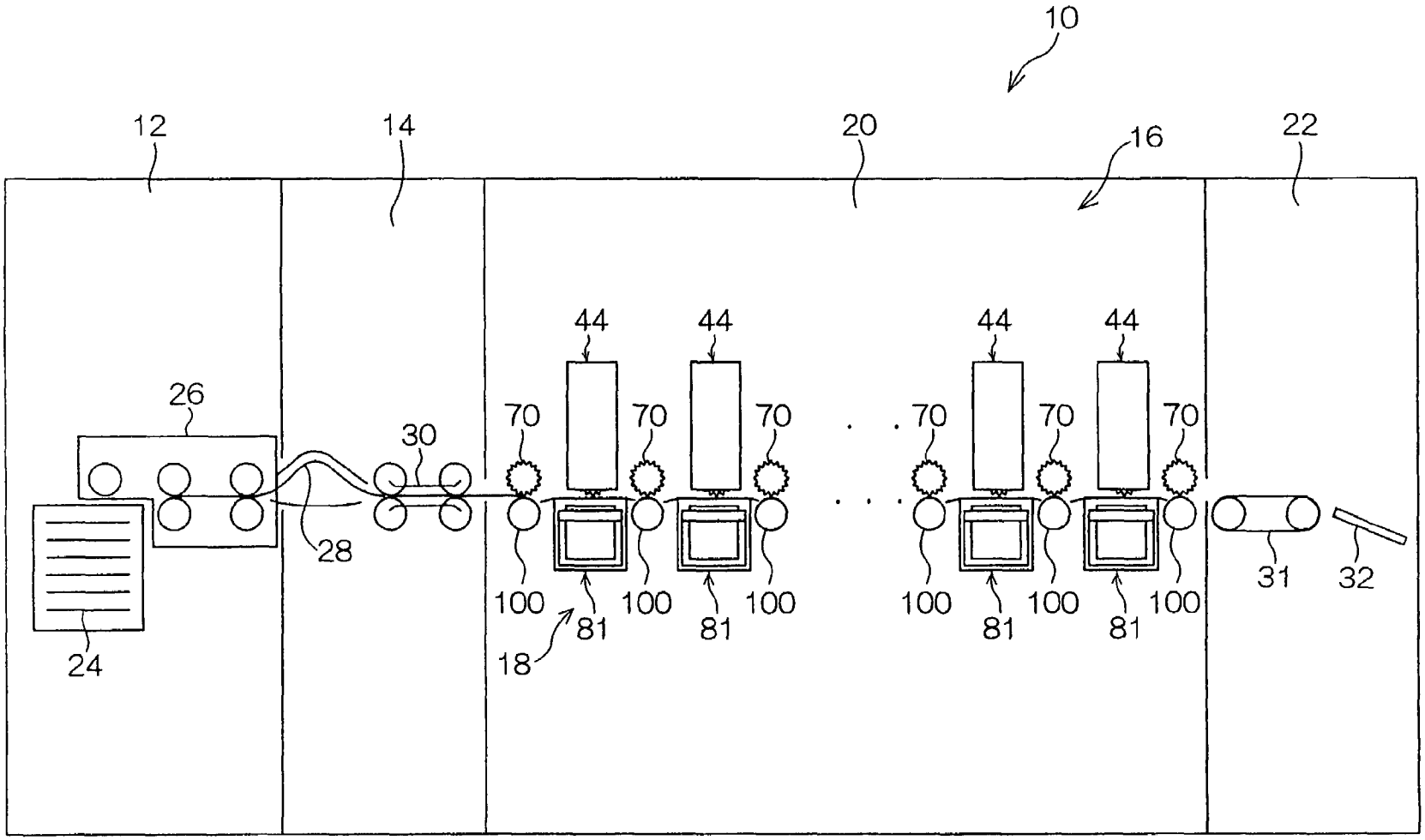
FIG. 1 is a schematic structural diagram showing a recording device of the present invention.
Figure 2:
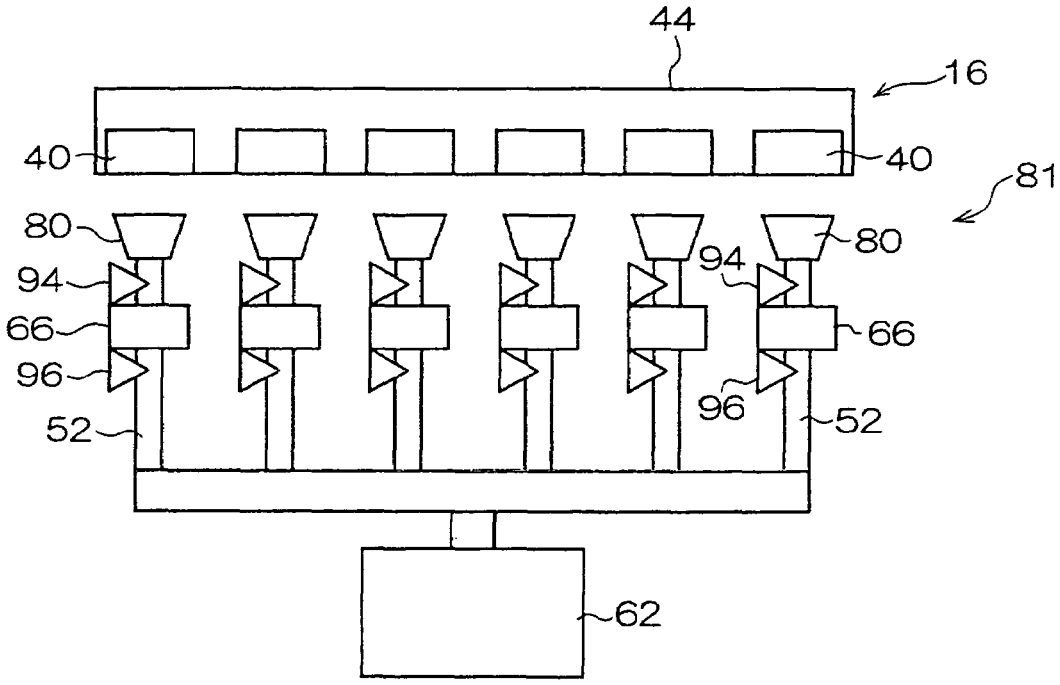
FIG. 2 is a schematic diagram showing an example of a basic structure of a maintenance device of the present invention.
Figure 3:
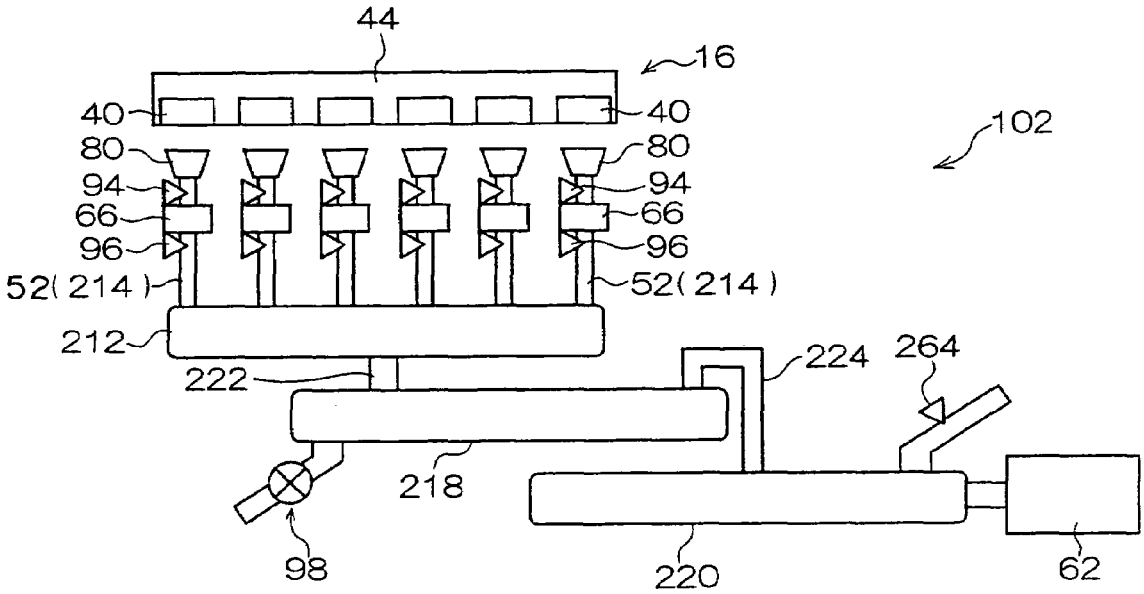
FIG. 3 is a schematic diagram showing a basic structure, which is different than that of FIG. 2, of the maintenance device of the present invention.

The basic structures of maintenance devices 81, 102 of the present invention are shown in FIGS. 2 and 3, respectively. Further, an inkjet recording device 10, to which the maintenance device 81 or the maintenance device 102 is applied, is shown in FIG. 1.

As shown in FIG. 1, the inkjet recording device 10 is basically structured from a sheet supplying section 12 which feeds out sheets; a registration adjusting section 14 which controls the posture of the sheet; a recording section 20 having a recording head portion 16 forming an image on the sheet by discharging ink drops, and a maintenance portion 18 carrying out maintenance of the recording head portion 16; and a sheet discharging section 22 discharging out the sheets on which images have been formed in the recording section 20.

The sheet supplying section 12 is structured by a stocker 24 in which sheets are stacked and accommodated, and a conveying device 26 which removes the sheets one-by-one from the stocker 24 and conveys them to the registration adjusting section 14.

The registration adjusting section 14 has a loop forming portion 28 and a guide member 30 which controls the posture of the sheet. Due to the sheet passing through this section, skewing of the sheet is corrected by utilizing the characteristic of the sheet by which its flat state is to be kept, and the conveying timing is controlled and the sheet enters into the recording section 20.

A sheet conveying path along which the sheet is conveyed is formed between the recording head portion 16 and the maintenance portion 18 in the recording section 20. The sheet is conveyed continuously (without stopping) while being nipped between star wheels 70 and conveying rollers 100. Ink drops are ejected out from the recording head portion 16 onto the sheet such that an image is formed on the sheet. The recording head portion 16 and the maintenance portion 18 are each formed as a unit. The recording head portion 16 is structured so as to be able to separate from the maintenance portion 18 sandwiching the sheet conveying path therebetween (more specifically, so as to be able to move upward). Accordingly, if there is a paper jam, the jammed sheets can be easily removed.

The sheet discharging section 22 accommodates, via a sheet discharging belt 31 and in a tray 32, the sheets on which images have been formed in the recording section 20.

As shown in FIG. 2, the recording head portion 16 has plural recording heads 44 corresponding at least to the respective colors of the inkjet recording device 10. Each of the recording heads 44 has plural unit heads 40. Ink drops are discharged onto the sheet from ink discharge openings (nozzles) provided at the unit heads 40, and an image is recorded on the sheet.

The maintenance device 81 has at least capping portions (ink recovery portions) 80 which correspond to the respective unit heads 40 and which can accommodate ink drops. Each of the capping portions 80 is connected to a suction device 62 via an individual waste ink flow path 52, such that ink can be suctioned from the unit heads 40. A small chamber 66, and a capping portion side opening/closing valve 94 and a suction portion side opening/closing valve 96 before and after the small chamber 66 (before and after in the direction in which the suctioned ink flows), are provided at each of the waste ink flow paths 52. By operating these opening/closing valves, the negative pressure of the suction portion 62 is applied to an appropriate degree to the interiors of the small chambers 66 and desired negative pressures are maintained, and the negative pressures within the small chambers 66 can be applied to the capping portions 80 at appropriate times.

It suffices that the small chamber 66 is structured such that the interior thereof can be maintained at the desired negative pressure in this way. Because the small chamber 66 has an opening cross-sectional surface area which is larger than that of the waste ink flow path 52, troubles such as, for example, the small chamber 66 becoming clogged by viscosity increased ink or waste or the like during suctioning such that the appropriate negative pressure cannot be maintained, can be obviated.

Further, by providing the small chamber 66 at each of the waste ink flow paths 52, the small chamber 66 is provided for each of the capping portions 80. Thus, the appropriate negative pressure can be applied to each of the capping portions 80, and the amount of suction can be adjusted.

The valve mechanisms structuring the capping portion side opening/closing valves 94 and the suction portion side opening/closing valves 96 are not limited provided that negative pressure can be generated and maintained within the small chambers 66, and it suffices for these valve mechanisms to be provided before and after the small chambers 66. In order to make the interior of the small chamber 66 be the appropriate negative pressure, it suffices to close the capping portion side opening/closing valve 94 and open only the suction portion side opening/closing valve 96, and drive the suction portion 62. At the stage when the appropriate negative pressure is reached, if the suction portion side opening/closing valve 96 is closed, the negative pressure within the small chamber 66 can be maintained. If the state in which the suction portion side opening/closing valve 96 is closed and only the capping portion side opening/closing valve 94 is opened, the appropriate negative pressure can be applied to the capping portion 80 at the desired time.

The suction portion 62 is not limited provided that it can generate negative pressure by suction. For example, a generally-used pump may be used.

In FIG. 3, a structure which is different than that of FIG. 2 is illustrated as the basic structure of the present invention. The maintenance device 102 of the basic structure shown in FIG. 3 is the same as FIG. 2 with regard to the point that the small chamber 66, the capping portion side opening/closing valve 94, and the suction portion side opening/closing valve 96 are provided at a first waste ink flow path 214 which extends from the capping portion 80, but differs in that the first waste ink flow path 214 communicates with a first chamber 212. The first chamber 212 communicates successively with a second chamber 218 and a third chamber 220. The negative pressure from the suction portion 62 is applied to the interior of the third chamber 220.

In this way, when the first chamber 212, which is used in common for the plural small chambers 66, is provided, at the time when negative pressure is applied to the interiors of the respective small chambers 66, the dispersion among the negative pressures of the small chambers 66 can be made to be small, and the negative pressures can be made to be more uniform. Namely, as shown in FIG. 2, even in the structure in which the respective small chambers 66 are directly connected to the suction portion 62, the interiors of the respective small chambers 66 can be made to be negative pressure, but in a case in which, at the respective small chambers 66, it is difficult to make the corresponding waste ink flow paths 52 have the same lengths, the substantial volumes of the portions from the suction portion 62 to the small chambers 66 are different. Dispersion thereby arises in the negative pressures within the small chambers 66, and dispersion also arises in the suction forces applied from the small chambers 66 to the capping portions 80. In order to reduce this dispersion, for example, a method has been conceived of in which the times over which the suction portion side opening/closing valves 96 are open are varied for each of the small chambers 66, or the like. However, here, the structure and the control become complex. In contrast, as shown in FIG. 3, merely by providing the first chamber 212, the first waste ink paths 214 can be made to have uniform lengths, and the dispersion in the negative pressures within the small chambers 66 can be reduced.

Note that the number of the small chambers 66 corresponding to the single first chamber 212 is not limited provided that there are two or more small chambers 66.

However, the fewer the small chambers 66, the smaller the effect of the first chamber for reducing the dispersion in the negative pressures of each of the small chambers 66. However, if only one first chamber 212 is provided so as to correspond to all of the small chambers 66, the first chamber 212 itself becomes large. Accordingly, it is preferable to provide at least one first chamber 212 for, for example, each of the recording heads 44 of the recording head portions 16.

Waste ink which is suctioned from the unit heads 40 flows into the first chamber 212. However, if a structure such that waste inks of different colors do not become mixed together in the same first chamber 212 is utilized, the waste inks can be recovered and reutilized, such that the amount of consumed ink can be made to be small. In this case, an ink feedback path is provided at the first chamber 212, such that the ink is fed-back to a main tank 68 or a sub tank 34 (refer to FIGS. 4 and 5) which will be described later.

In order to make the interior of the first chamber 212 be negative pressure, the suction portion 62 may be connected directly to the first chamber 212, but a pressure sensor must be provided in order to detect the degree of suction (i.e., the negative pressure) by the suction portion 62. Thus, at least one air chamber is newly provided between the first chamber 212 and the suction portion 62, and the pressure sensor is disposed in this air chamber. In this case, providing yet another air chamber between the first chamber 212 and this air chamber in which the pressure sensor is disposed is preferable, because it then becomes difficult for the waste ink within the first chamber 212 to flow into the air chamber in which the pressure sensor is disposed. In the example shown in FIG. 3, the third chamber 220 is provided as the air chamber in which the pressure sensor is disposed. The second chamber 218 is provided in order to prevent ink from flowing into the third chamber 220 from the first chamber 212.

A plurality of the second chambers 218 may be provided. However, because there is no problem even if color mixing occurs within the second chamber 218, it suffices to provide a single second chamber 218 in common for, for example, all of the first chambers 212. The waste ink within the second chamber 218 can be recovered and disposed of or the like by a waste ink recovery portion 98.

It suffices for the third chamber 220 to have at least a capacity of an extent that the pressure sensor can be disposed therein. Further, although the number of third chambers 220 which are provided is not limited, providing one third chamber 220 is preferable because the degree of the suction by the suction portion 62 can be known in mono-way, and the number of parts can be reduced and the structure can be simplified.

EMBODIMENTS

Next, embodiments of the present invention will be described.

Figure 4:
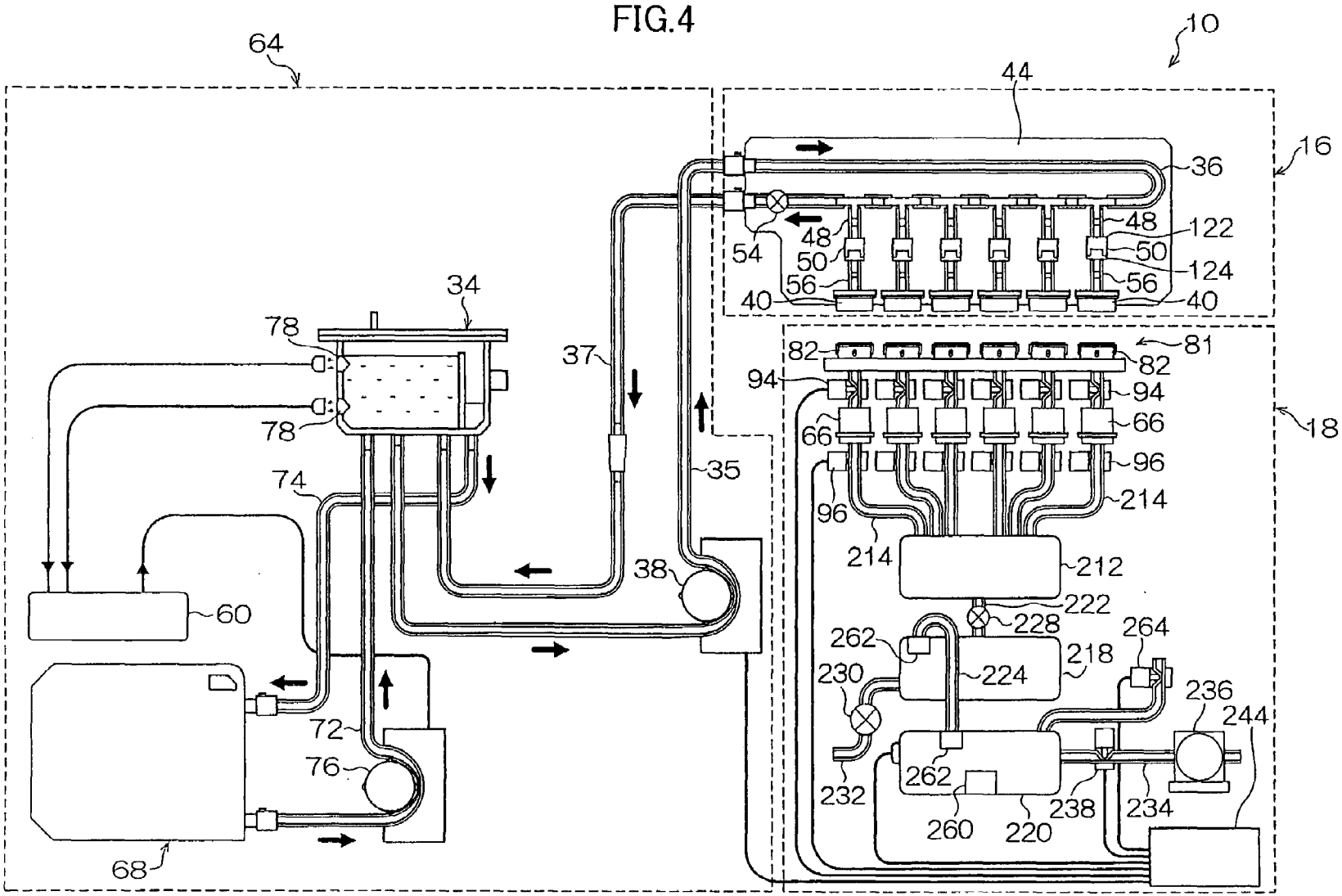
FIG. 4 is a schematic structural diagram showing a recording device of a first embodiment.

An ink supplying section 64, the maintenance portion 18, and the recording head portion 16 of the inkjet recording device 10 of the first embodiment of the present invention are shown in FIG. 4.

The ink supplying section 64 has the main tank 68 in which ink is accumulated in advance, and the sub tank 34 to which ink is fed from the main tank 68 and in which the ink is temporarily accumulated. The main tank 68 and the sub tank 34 communicate by a main supply path 72 and a main feed-back path 74. By a main pump 76 provided at the main supply path 72, ink can be fed from the main tank 68 to the sub tank 34, and ink can be fed-back from the sub tank 34 to the main tank 68.

An ink circulating path 36 is connected from the sub tank 34 via an ink supply path 35 and an ink feed-back path 37. The ink of the sub tank 34 can be circulated in the ink circulating path 36 by a sub pump 38.

Liquid level sensors 78, which detect the liquid surface of the ink, are provided in the sub tank 34. The information regarding the liquid level detected by the liquid surface sensors 78 is transmitted to an ink supply controller 60. The main pump 76 is controlled on the basis of this information.

The specific structures of the main pump 76 and the sub pump 38 are not particularly limited provided that they can reliably feed-out the ink. However, using a roller pump, for example, is preferable in that the amount of ink which is fed out can be adjusted by a simple structure.

Note that it is preferable that the main supply path 72, the main feed-back path 74, the ink supply path 35, the ink circulating path 36, the ink feed-back path 37, and individual flow paths 48 are tubes which are structured of a material which is ink-resistant and which is rigid to the extent that the tube will not be inadvertently crushed by the pressure from the ink (or the negative pressure, depending on the case). Moreover, in cases in which roller pumps are used as the main pump 76 and the sub pump 38 as described above, and in cases in which the structures shown in FIGS. 14A, 14B and FIGS. 15A, 15B are used as the capping portion side opening/closing valves 94 and the suction portion side opening/closing valves 96 and the like which will be described later, the tubes must have flexibility (elasticity) to the extent that the tubes collapse to an appropriate degree (sink-in or curve locally) due to external pressure. As specific examples of materials of the tubes, various types of rubber tubes and resin tubes may be used, but PVD tubes, Tygon tubes ("Tygon" is a tube made of soft PVC soft polyvinyl chloride vinyl and is the trade name of a product manufactured by Saint-Gobain/Norton Corporation), latex tubes, polyethylene tubes and the like having excellent ink resistance are preferable. Further, in cases of using pumps of the type which squeeze the tubes such as the roller pumps as described above, it is preferable to use a soft silicon tube. Note that it is possible to use respectively different tube materials which are appropriate for the main supply path 72, the main feed-back path 74, the ink circulating path 36, and the individual flow paths 48, respectively.

As shown in FIG. 4, a connecting flow path 56, which is connected to the individual flow path 48, is provided at each of the unit heads 40. Removable units 122, 124 are provided at the connected portions of the individual flow paths 48 and the connecting flow paths 56, respectively. Each of the unit heads 40 can independently be attached and removed easily to and from the individual flow paths 48.

Provided that the recording head 44 is an inkjet recording head which can discharge ink drops from a nozzle surface 40A of the recording head 44, the type of ink and the method of discharging the ink drops are not limited. Note that the method of discharging ink drops of the unit heads 40 is not limited to an inkjet method. If the unit head 40 is a type which directly transfers a coloring material to a sheet without contacting the sheet, the method thereof is not limited. The inkjet method is an exemplary method, but any method may be used provided that it is a known method. Further, the inkjet method is not limited to a thermal inkjet method, a piezo inkjet method, a continuous flow inkjet method, an electrostatic suction inkjet method, or the like.

Any of a water-based ink, an oil-based ink, a so-called solid ink which is solid at room temperature, a solvent ink, or the like may be used as the ink which is utilized. The coloring agent within the ink may be a pigment or a dye.

Figure 6:
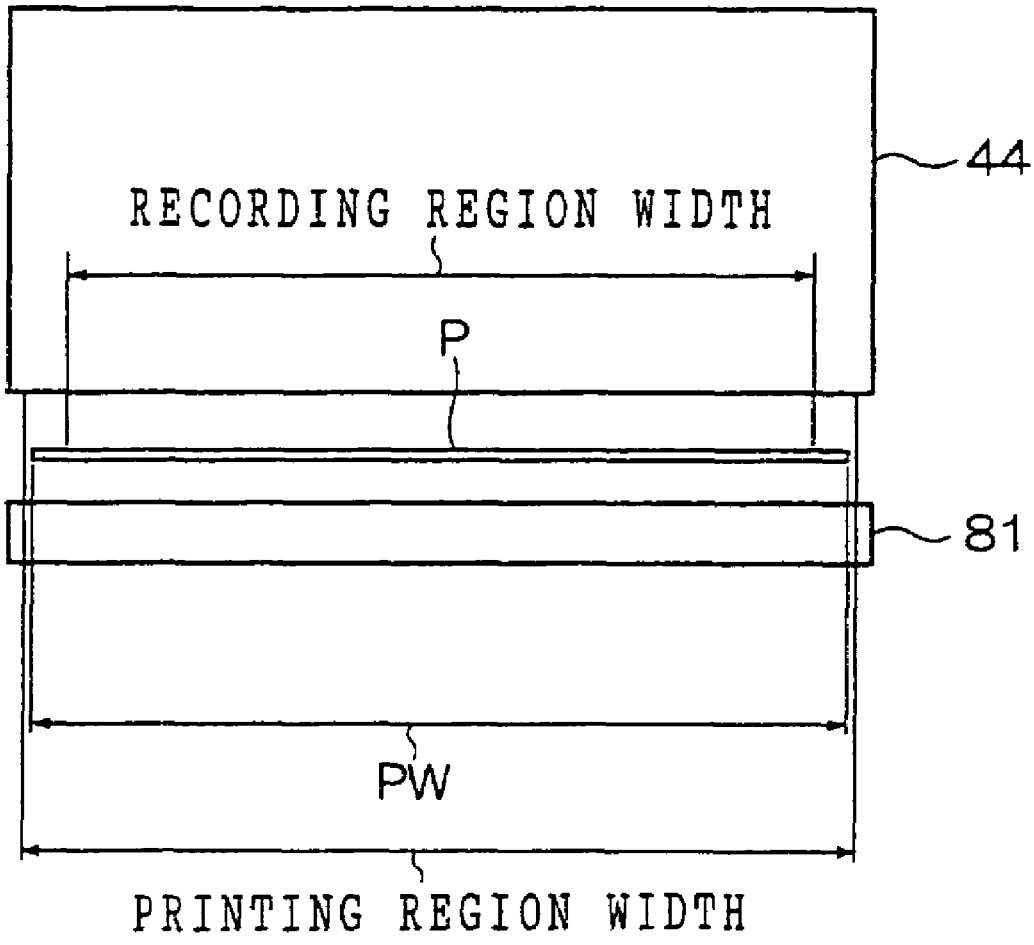
FIG. 6 is a diagram explaining a printing region of the recording devices relating to the embodiments of the present invention.

As shown in FIG. 6, the printing region of the recording head 44 is set so as to correspond to a maximum sheet width PW among sheets P which are printed. Here, the printing region is base on the largest recording region among recording regions obtained by subtracting the margins, at which printing is not carried out, from the both edges of the sheet. However, the printing region is generally larger than the maximum sheet width PW which is the object of printing. This is because there is the concern that the sheet may be conveyed at an incline of a predetermined angle with respect to the conveying direction (i.e., may be conveyed in a skewed manner), and also because the demand for borderless printing is high.

Figure 7:
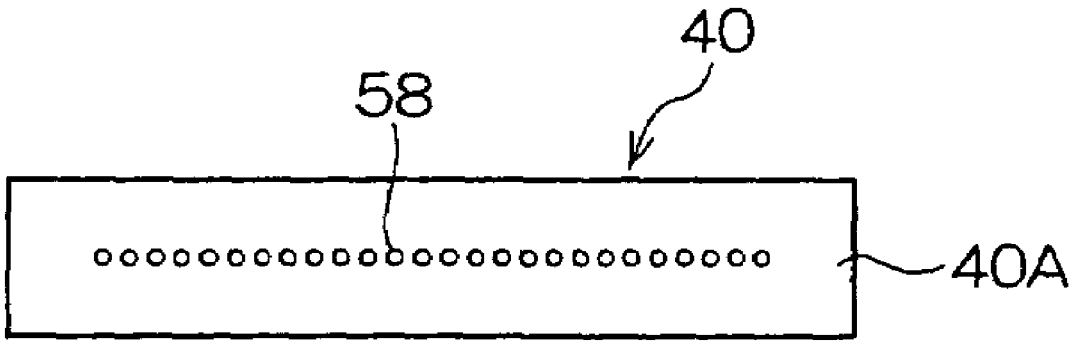
FIG. 7 is a diagram explaining a variation of a unit head relating to the embodiments of the present invention.

The recording head 44 is structured from a monolithic, elongated, recording head tip. Namely, the recording head 44, which can print in correspondence with the sheet width without intermission, can be formed by disposing plural recording head arrays 42A, 42B in the conveying direction (see FIG. 8). The recording head arrays 42A, 42B use the unit recording heads 40 (see FIG. 7), at whose both ends nozzles 58 are not formed. In the recording head arrays 42A, 42B, pluralities of these unit heads 40 are disposed at common substrates 46A, 46B at uniform intervals in the direction in which the nozzles are lined-up. In this case, the structure can be made to be even more compact by forming the recording head arrays 42A, 42B at the both surfaces of a single common substrate 46 (see FIG. 9).

Figure 10:
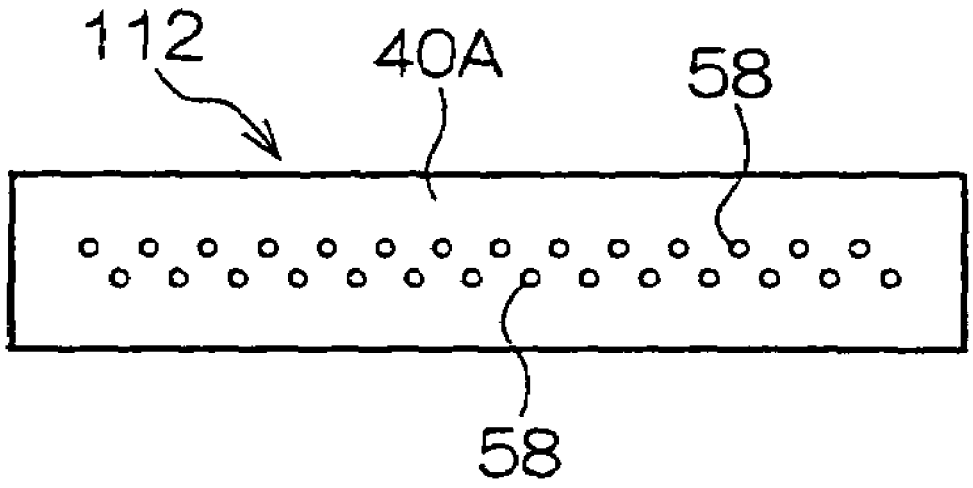
FIG. 10 is a diagram explaining a variation of the unit head relating to the embodiments of the present invention.

Although the nozzles of the unit head 40 are lined-up in a single straight line, the present invention is not limited to the same. For example, as shown in FIG. 10, the nozzles 58 may be lined-up in a staggered manner.

At the inkjet recording device 10, four (or more than four) of the recording heads 44 are lined-up in the conveying direction. Full color printing can be carried out by the recording heads 44 discharging ink drops of yellow (Y), magenta (M), cyan (C), and black (K), respectively.

Figure 11:
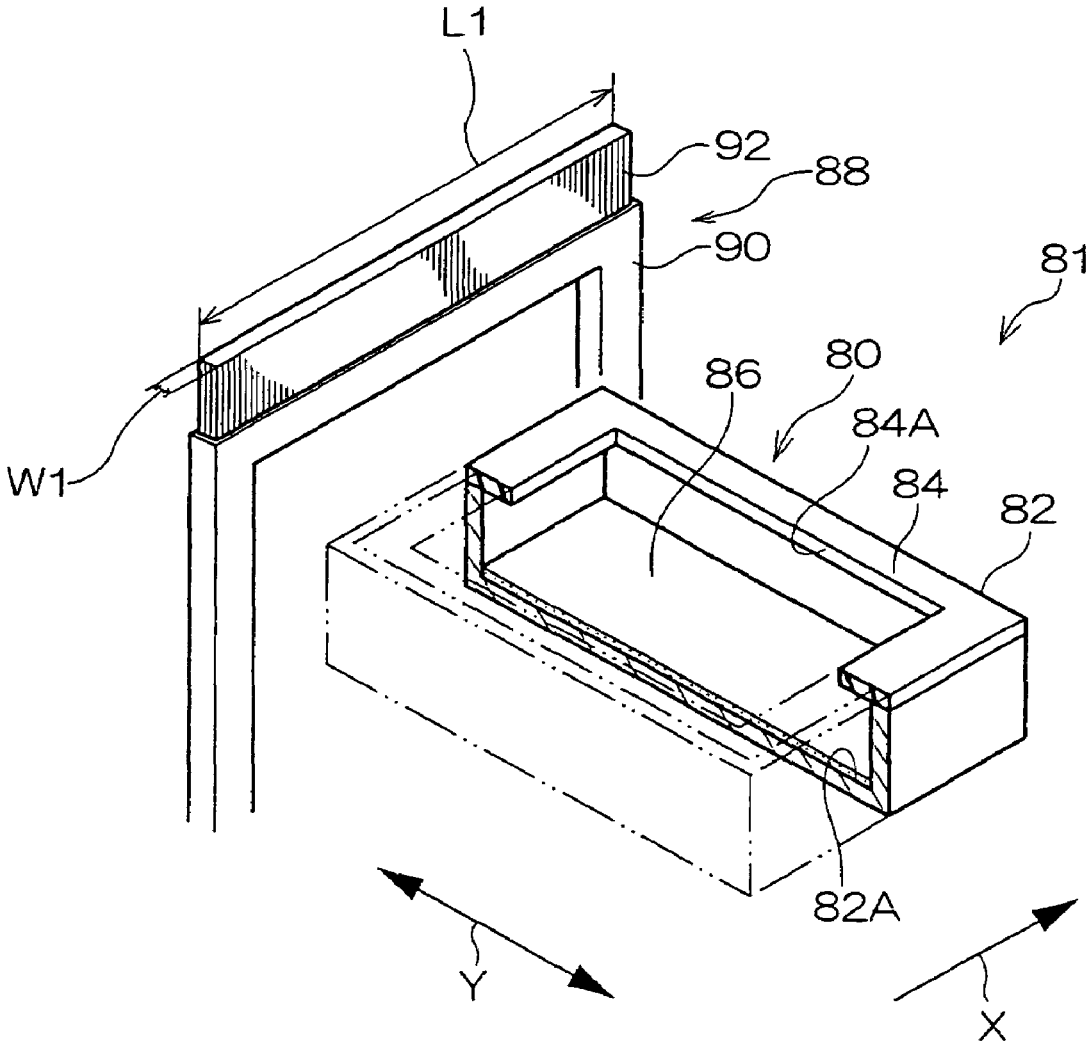
FIG. 11 is a perspective view showing a maintenance device which can be applied to the recording device of the present invention.

On the other hand, as shown in FIG. 11, the maintenance device 81, which is disposed to face the recording head 44, has the capping portions (ink accommodating portions) 80 which correspond to the respective unit heads 40 and can accommodate ink drops, and cleaning portions 88 which clean the nozzle surfaces 40A of the recording head 44. The capping portions 80 have the function of accommodating and holding the ink drops which have been discharged from the recording head 44. To this end, the capping portion 80 is structured from, for example, a receiving member 82 having a concave portion 82A formed so as to correspond to the nozzle surface 40A (see FIG. 7 and the like) of the recording head 44, and an ink absorbing body 86 disposed at the floor of the concave portion 82A of the receiving member 82 and holding the ink. The receiving member 82 is fit tightly to the nozzle surface 40A so as to set an airtight state.

Figure 12A:
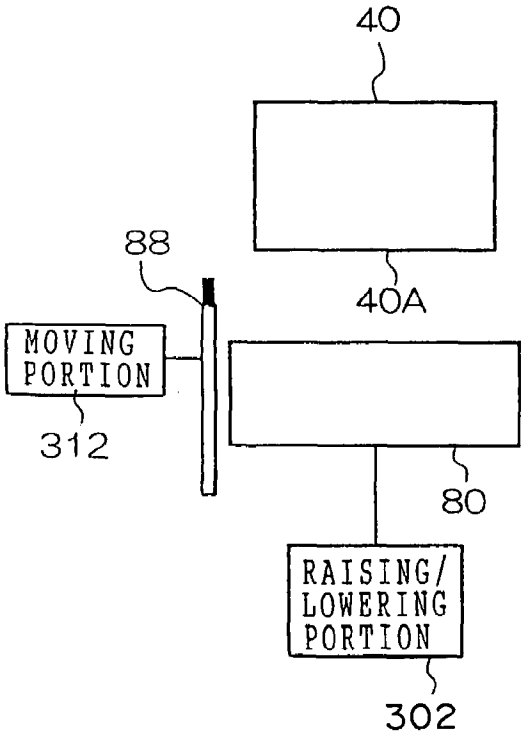
FIGS. 12A through 12C are diagrams explaining operation of the maintenance device shown in FIG. 11.
Figure 12B:
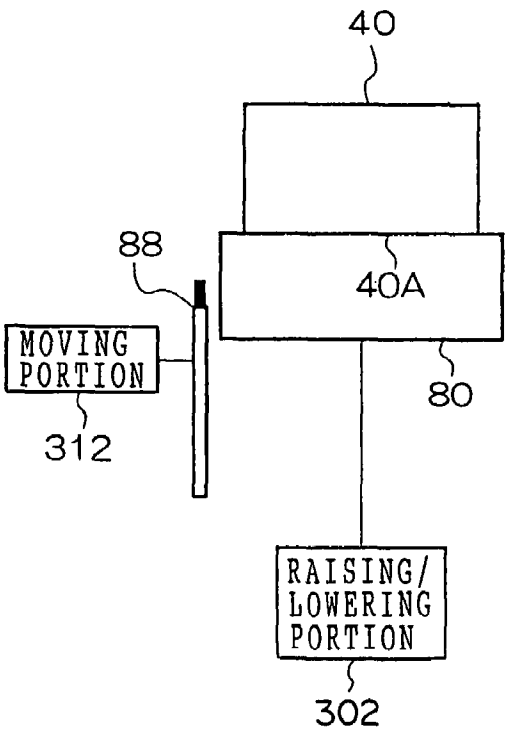
Figure 12C:
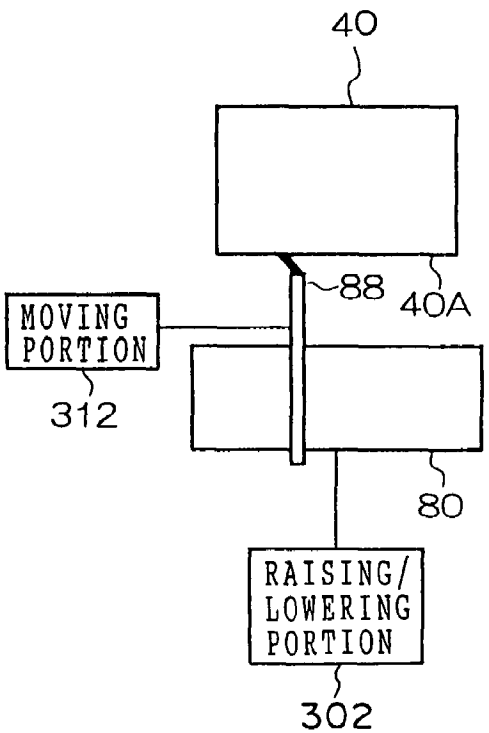

The capping portion 80 can approach and move away from the nozzle surface 40A of the recording head 44 by a raising/lowering portion 302 shown in FIGS. 12A, 12B and 12C. (Hereinafter, this approaching and moving away will be called raising and lowering of the capping portion 80.) Due to the capping portion 80 press-contacting the nozzle surface 40A, the capping portion 80 can set the nozzle surface 40A in an airtight state (i.e., can carry out capping). Accordingly, as shown in FIG. 11, a rubber portion 84 is provided at the top portion (the nozzle surface side) of the receiving member 82 in order to make the nozzle surface 40A of the recording head 44 airtight at the time of press-contact. Further, the capping portion 80 (the rubber portion 84) is formed in a shape which covers the entire nozzle surface so as to prevent drying of the recording liquid in the nozzles, and so as to prevent the adhesion of dirt, dust and the like to the nozzle surface 40A.

Examples of the plastic material structuring the receiving member 82 are POM, PET, PBT, PPS, nylon 66, acryl, bakelite, and the like. However, PBT is preferable from the standpoints of moldability, shock resistance, and the like.

Any of various elastic members can be used as the rubber material structuring the rubber portion 84, such as natural rubbers like raw rubber, isoprene rubber, butadiene rubber, olefin rubber, ethyl rubber, polysulfide rubber, urethane rubber, fluorine rubber, silicone rubber and the like; any of various types of elastomers (rubber elastic bodies); blend rubbers formed by blending any of these rubber materials; blend rubbers formed by blending any of these rubber materials and any of various plastics; and the like. Combinations formed by adhering, or the like, these materials may be used.

Among these materials, hydrogenated nitrile butadiene rubber, ethylene propylene rubber (EPDM), polydimethyl silicone rubber, methyl vinyl silicone rubber, methyl phenyl silicone rubber, fluorosilicone rubber, and the like are preferable from the standpoints of weather resistance, chemical resistance, wear resistance, and workability.

As the material of the ink absorbing body 86, polyester felt fiber materials and acrylnitrile felt fiber materials are preferable, and in addition, materials formed by blending a polyester felt fiber material and an acrylnitrile felt fiber material are preferable. The ink retaining ability of the ink absorbing body 86 can be finely adjusted by appropriately changing the fiber diameter, the fiber length, the direction of orientation, and the like of the fiber material which is used.

Other examples include polyamide fiber materials, polypropylene fiber materials, polyvinyl alcohol fiber materials, polyvinylidene chloride fiber materials, polyurethane fiber materials, and the like.

When the absorption of the recording liquid such as ink or the like is considered, polyester fiber materials are more preferable, and use of a material in which the aforementioned materials are blended also is suitable.

The cleaning portion 88 is for removing dirt, dust, ink and the like at the nozzle surface 40A of the recording head 44, so as to keep the ink drop discharging performance constant.

As shown in FIG. 11, the cleaning portion 88 is structured from a wiper 92, a holding member 90 which holds the wiper 92, and a moving portion 312 (see FIGS. 12A, 12B, 12C) which raises and lowers the cleaning portion 88 and moves the cleaning portion 88 in the transverse direction.

The wiper 92 cleans the entire nozzle surface by moving along the nozzle surface 40A of the recording head 44 (see FIG. 12C) by the moving portion 312 while slidingly contacting the nozzle surface 40A. At this time, because the capping portion 80 is disposed at a position facing the recording head 44 (the unit head 40), the cleaning portion 88 moves between the unit head 40 (the nozzle surface 40A) and the capping portion 80. For example, as shown in FIG. 11, a structure can be used in which the holding member 90 of the cleaning portion 88 is formed as an arch, and straddling over the capping portion 80 and moving in a state of making the wiper 92 press-contact the nozzle surface 40A of the unit head 40.

It suffices for the direction of movement (sliding-contact) of the wiper 92 to be, for example, the sheet conveying direction or the transverse direction which is orthogonal to the sheet conveying direction. Further, the movement may be a reciprocating operation, rather than just movement in one direction.

The holding member 90 which holds the wiper 92 is structured from a metal material which is strong, such as aluminum or SUS or the like.

In order for the wiper 92 to have a predetermined rigidity, it is preferable that the rubber hardness is 30 to 80, and that the ratio of a longitudinal (conveying) direction length L1 and a short-side (transverse) direction width W1 is 5:1 to 50:1, and that the width W1 is 0.5 to 4 mm. If the rubber hardness is less than 30, or the ratio of the length L1 and the width W1 is greater than 50:1, or the width W1 is less than 0.5 mm, the rigidity of the wiper 92 will be too low, and the wiper 92 will not be able to sufficiently abut the nozzle surface 40A, and cleaning will be difficult. On the other hand, if the rubber hardness is greater than 80, the ratio of the length L1 and the width W1 is less than 5:1, or the width W1 is greater than 4 mm, the rigidity of the wiper 92 will be too high, the wiper 92 will not be able to fit sufficiently tightly to the nozzle surface 40A, and cleaning will be difficult.

Any of various elastic members can be used as the material structuring the wiper 92, such as natural rubbers like raw rubber, isoprene rubber, butadiene rubber, olefin rubber, ethyl rubber, polysulfide rubber, urethane rubber, fluorine rubber, silicone rubber and the like; any of various types of elastomers (rubber elastic bodies); blend rubbers formed by blending any of these rubber materials; blend rubbers formed by blending any of these rubber materials and any of various plastics; and the like. Combinations formed by adhering, or the like, these materials may be used.

Among these materials, hydrogenated nitrile butadiene rubber, ethylene propylene rubber (EPDM), polydimethyl silicone rubber, methyl vinyl silicone rubber, methyl phenyl silicone rubber, fluorosilicone rubber, and the like are preferable from the standpoints of weather resistance, chemical resistance, wear resistance, and workability.

Excellent thermoplastic elastomers and the like also are preferable from the standpoints of fatigue resistance, mold resistance, rubber characteristics and the like.

The surface thereof may be covered by a protective layer. Fluorine resin, which has an excellent ink repelling ability and a low friction coefficient characteristic, is preferably used for the protective layer.

Various types of plastic materials also can be used. Specific examples include molded bodies of polyester resins such as polyethylene terephthalate, polybutylene terephthalate, and the like, polyvinyl chloride resins, polyvinylidene chloride resins, epoxy resins, polycarbonate resins, polyethylene resins, polypropylene resins, polystyrene resins, and the like.

Further, a structure in which films of these materials are stacked and laminated together may be cut with high accuracy. Acrylic polymers, rubber polymers, or the like may be used as the laminating agent here.

As shown in FIG. 4, the first chamber 212 which is used in common for the entire one recording head 44 is disposed in a vicinity of (in FIG. 4, beneath) the receiving members 82. The receiving members 82 and the first chamber 212 are connected by the first waste ink flow paths 214 having the capping portion side opening/closing valves 94, the small chambers 66, and the suction portion side opening/closing valves 96. The first waste ink flow paths 214 are not limited provided that they communicate the receiving members 82 (the capping portions 80) and the first chamber 212 and can guide the ink within the receiving members 82 to the first chamber 212 without leakage. However, the first waste ink flow paths 214 must be ink resistant, must be rigid such that they are not collapsed by the applied negative pressure, and must be flexible because they move so as to follow the receiving members 82.

When the capping portion side opening/closing valves 94 and the suction portion side opening/closing valves 96 are structured so as to close the tubes by crushing the first waste ink flow paths 214, such as electromagnetic solenoid valves which will be described later or the like, it suffices to select tubes of a flexibility, size, and thickness corresponding thereto.

It is more preferable that the ink flow paths of the respective small chambers 66 from the respective capping portions 80 are the same length, in order to make the decrease in negative pressure uniform.

In the same way as the main supply path 72, the main feed-back path 74, the ink supply path 35, the ink circulating path 36, the ink feed-back path 37, the individual flow paths 48, and the like, specific examples of materials of the tubes are any of various types of rubber tubes and resin tubes, but PVC tubes, Tygon tubes, latex tubes, polyethylene tubes and the like which have excellent ink resistance are preferable. In particular, when valve mechanisms (electromagnetic solenoid valves which will be described later, or the like) which collapse and close the tubes are used as the capping portion side opening/closing valves 94 and the suction portion side opening/closing valves 96, it is preferable to use soft silicon tubes so that the tubes are easy to collapse. Further, respectively different, appropriate tube materials may be used at respective places.

The small chamber 66 functions to maintain the negative pressure needed at the time of suctioning the ink from the capping portion 80, and is rigid to the extent that it does not collapse inadvertently due to the negative pressure at the interior thereof. Further, the small chamber 66 has a volume such that a predetermined amount of ink can be suctioned by the negative pressure at the interior, and must have at least a volume which is greater than or equal to the amount of ink which it is supposed will be suctioned out.

The small chamber 66 must have an opening cross-sectional surface area which is greater than the opening cross-sectional surface area of the first waste ink flow path 214, so that the pressure of the suction does not fall when the suctioned ink passes through the interior of the small chamber 66. From this standpoint, a greater opening cross-sectional surface area of the small chamber 66 is better. However, because the small chambers 66 are disposed adjacent to one another, the upper limit of the opening cross-sectional surface area is determined by the overall size of the recording head portion 16, the recording size which is recorded by the inkjet recording device 10, and the like. More specifically, it depends on the amount of ink which must be suctioned, the flow path structure and the nozzle diameter of the recording head 44, the number of nozzles allotted to each capping portion 80, and the like, but as an example, a cylindrical tube shaped plastic having a volume of 4 ml (a cross-sectional surface area diameter of 2 cm) can be used with respect to a suctioned amount of 2 ml.

Examples of the material structuring the small chambers 66 are molded bodies of various types of resin materials (polyester resins such as polyethylene terephthalate, polybutylene terephthalate and the like, polyvinyl chloride resins, polyvinylidene chloride resins, epoxy resins, polycarbonate resins, polyethylene resins, polypropylene resins, polystyrene resins, acrylic resins, fluorine resins, PEEK, and the like), plastic materials (POM, PET, PBT, PPS, nylon 66, acrylic, bakelite), as well as metal and glass.

It suffices for the capping portion side opening/closing valves 94 and the suction portion side opening/closing valves 96 to be able to maintain the airtight states within the small chambers 66, and to be able to open and close the first waste ink flow paths 214 before and after the small chambers 66. Accordingly, it suffices for the capping portion side opening/closing valves 94 and the suction portion side opening/closing valves 96 to be able to ensure airtightness with respect to the first waste ink paths 214 even in the state in which the necessary negative pressure is generated. As specific structures, for example, structures which are the same as those of FIGS. 13A, 13B through FIGS. 15A, 15B, which will be described later, can be employed. In particular, when silicon tubes are used as the first waste ink flow paths 214, electromagnetic solenoid valves (see FIGS. 14A, 14B), which can collapse the tubes electromotively, are ideal.

Before and after the small chambers 66, the first waste ink flow paths 214 are closed by the capping portion side opening/closing valves 94 and the suction portion side opening/closing valves 96, respectively, such that the airtight states of the interiors of the small chambers 66 are maintained. The specific structures of the valve mechanisms thereof are not particularly limited provided that they can reliably close the first waste ink flow paths 214. However, for example, the various structures shown in FIGS. 13A, 13B through FIGS. 15A, 15B can be employed.

Figure 13B:
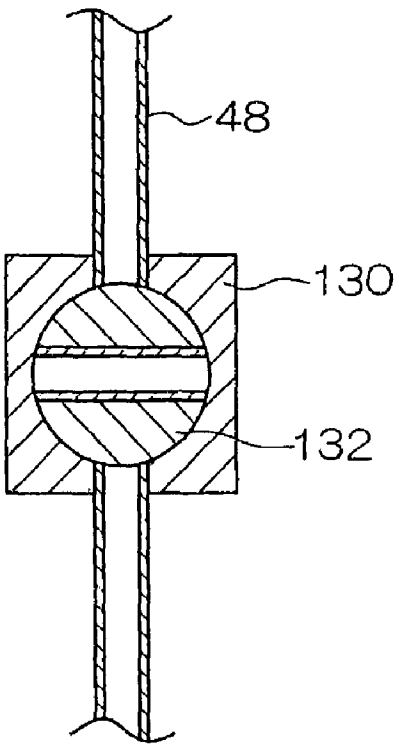
FIGS. 13A and 13B are sectional views showing an example of a valve mechanism relating to the present invention, where
Figure 13A:
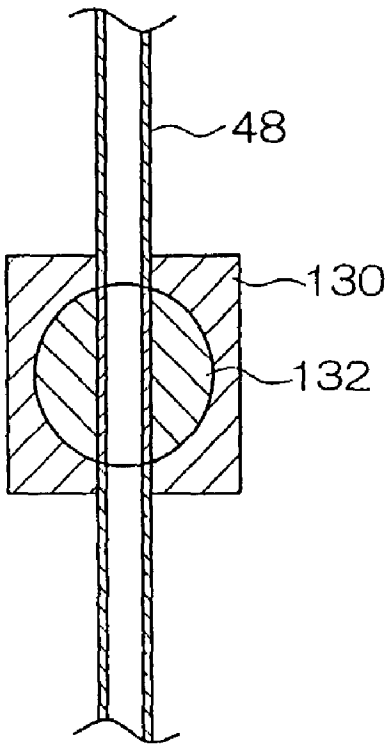

The valve mechanism shown in FIGS. 13A, 13B has a valve main body 132 which is rotatably accommodated within a block portion 130. The valve main body 132 is rotated so as to be able to open (see FIG. 13A) and close (see FIG. 13B) the first waste ink flow path 214.

Figure 14B:
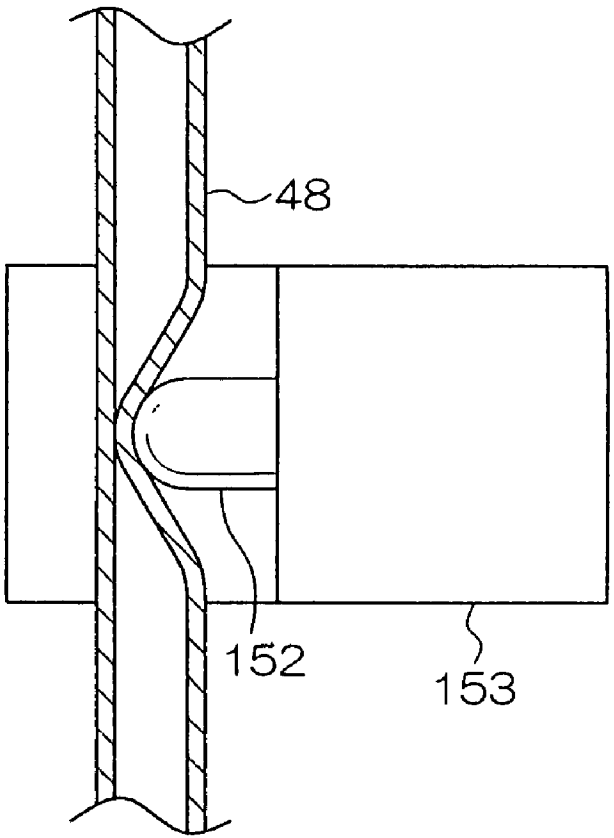
FIGS. 14A and 14B are sectional views showing an example, which is different from that of FIGS. 13A and 13B, of a valve mechanism relating to the present invention, where
Figure 14A:
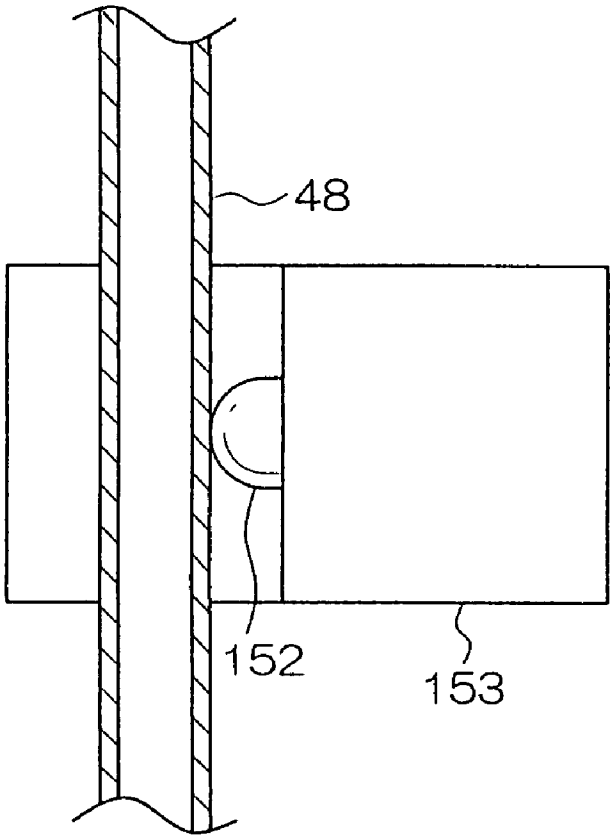

The valve mechanism shown in FIGS. 14A, 14B also can be used. In this example, in a case in which the first waste ink flow path 214 is structured by a flexible tube, the tube is pushed and collapsed by a pushing member 152 so as to be closed (see FIG. 14B), and the tube is opened by withdrawing the pushing member 152 (see FIG. 14A). For example, a solenoid or a motor can be used as a moving mechanism 153 for moving the pushing member 152, and an electromagnetic solenoid valve in particular is preferable.

Figure 15B:
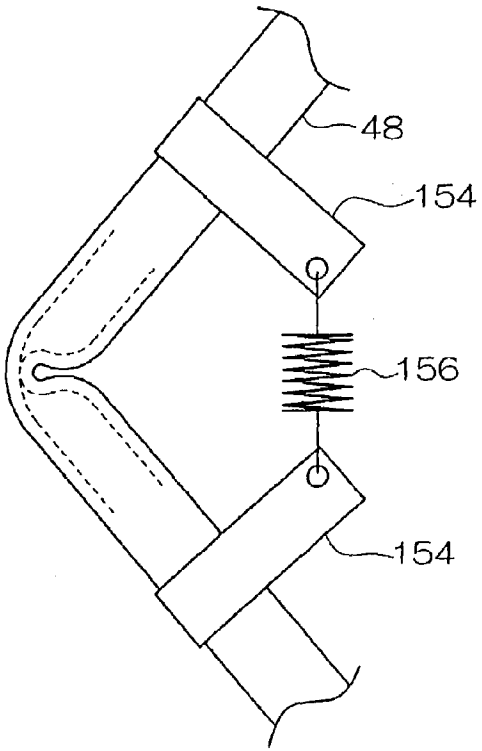
FIGS. 15A and 15B are sectional views showing an example, which is different from those of FIGS. 13A and 13B and FIGS. 14A and 14B, of a valve mechanism relating to the present invention, where
Figure 15A:
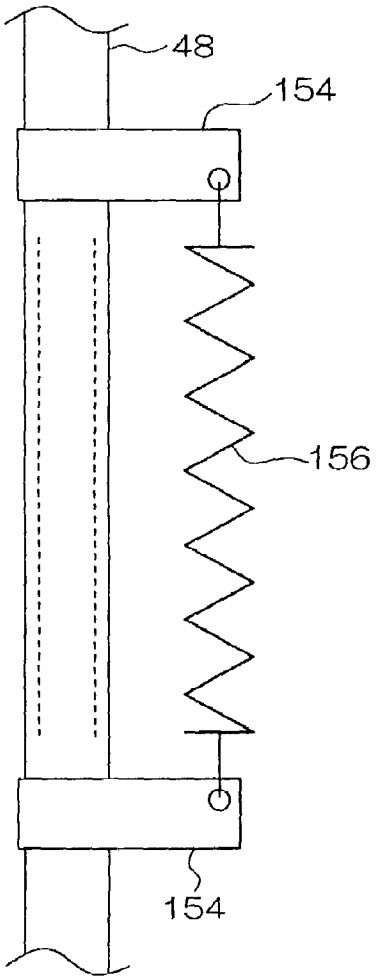

In the example shown in FIGS. 15A, 15B, at least two places of the first waste ink flow path 214, which similarly is structured by a flexible tube, are held by holding members 154, and the holding members 154 are made to approach one another by an extending/contracting mechanism 156 disposed between the holding members 154. Namely, due to the holding members 154 approaching one another, the tube is bent locally and closes (see FIG. 15B), and when the holding members 154 move away from one another, the tube is opened so as to return to a rectilinear form (see FIG. 15A). In this structure, a solenoid or a spring or the like can be used as the extending/contracting mechanism 156. If the portion at the substantial center of the places held by the holding members 154 is locally made to have low elasticity, the tube can be bent at this portion and can be closed more reliably.

The small chambers 66 are connected via the first waste ink flow paths 214 to the first chamber 212. As can be understood from FIG. 4, the single first chamber 212 is provided for a plurality of (in FIG. 4, six of) the small chambers 66. The negative pressure within the first chamber 212 is applied uniformly to the respective small chambers 66. In contrast, if, for example, the small chambers 66 are connected directly to an air intake pump 236 which will be described later, there may be the concern that dispersion will arise in the levels of the negative pressures at the respective small chambers 66. However, in the present embodiment, uniform negative pressure can be applied to the small chambers 66.

In a structure in which, for example, the plural recording heads 44 which correspond to inks of plural colors are used, if the first chambers 212 are provided at least for each of the colors, the inks can be suctioned color-by-color. Therefore, the accumulated inks can be fed-back to the main tanks 68 or the sub tanks 34 and reused. In a recording device which records a so-called full color image, inks of the four colors of YMCK are generally used. Thus, it is preferable to provide at least one first chamber 212 for each color, for a total of four (or more) of the first chambers 212. Further, because the recording heads 44 are disposed such that the respective colors are lined up in the sheet conveying direction, providing plural first chambers 212 is preferable because suctioning can be carried out in a short time independently for each of the colors.

Figure 8:
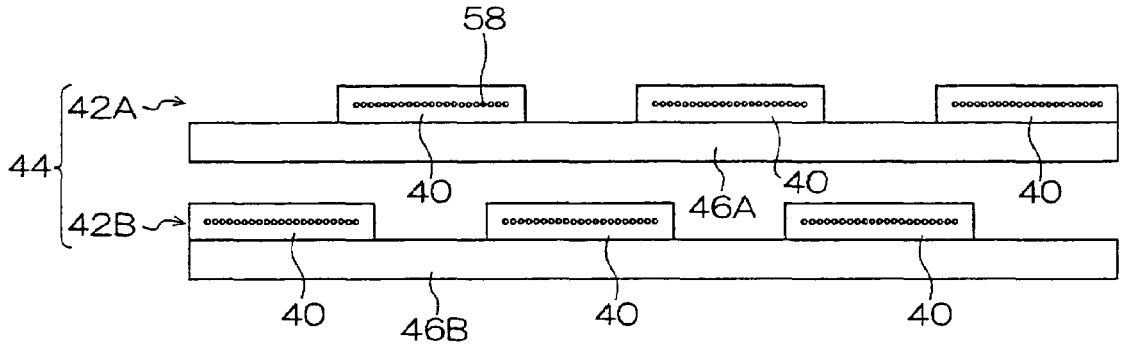
FIG. 8 is a diagram explaining a variation of a recording head relating to the embodiments of the present invention.
Figure 9:
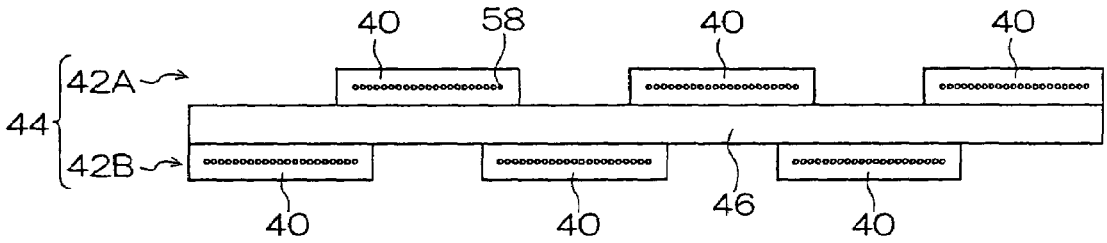
FIG. 9 is a diagram explaining a variation of the recording head relating to the embodiments of the present invention.

Further, the first chamber 212 may be provided for each of the recording head arrays 42A, 42B (see FIG. 8 or FIG. 9). In this structure, because the first chamber 212 corresponds one-to-one to each of the recording head array 42A and the recording head array 42B, the first chamber 212 can be operated for each recording head array 42A in the maintenance operation for example. In the present embodiment, because each color is structured by the two recording head arrays 42A, 42B, a total of eight of the first chambers may be provided.

The volume of the first chamber 212 must be of an extent such that the suctioned waste ink can be temporarily accumulated therein. However, even if this condition is satisfied, if the volume is too small, the flow path resistance cannot be ignored, and there is the concern that dispersion may arise in the negative pressures of the respective small chambers 66. Thus, it is preferable to ensure an appropriate volume for the first chamber 212. The specific volume depends also on the number of capping portions 80 (receiving members 82) corresponding to one first chamber 212 and the amount of ink suctioned per one capping portion 80, but it suffices for the volume to be three to five times, and preferably 10 times or more, the total amount of these volumes. In the present embodiment, as an example, in one suction operation, 2 ml of ink is suctioned at each capping portion 80, and 12 of the capping portions 80 correspond to one first chamber 212. Therefore, the total suctioned amount is 2 ml×12 caps which is 24 ml. Thus, the volume of the first chamber 212 is set to be 0.5 liters such that a sufficient volume is ensured.

The material structuring the first chamber 212 is not limited provided that it has sufficient rigidity to the extent that it does not collapse inadvertently with respect to the internal negative pressure. For example, the material may have appropriate elasticity provided that it has reversibility to the extent that it does not collapse under the needed negative pressure. Further, the material structuring the first chamber 212 must be ink resistant and corrosion resistant, and the interior may be coated in order to repel ink. Specific examples include, in the same way as the small chambers 66, molded bodies of various types of resin materials (polyester resins such as polyethylene terephthalate, polybutylene terephthalate and the like, polyvinyl chloride resins, polyvinylidene chloride resins, epoxy resins, polycarbonate resins, polyethylene resins, polypropylene resins, polystyrene resins, acrylic resins, fluorine resins, PEEK, and the like), plastic materials (POM, PET, PBT, PPS, nylon 66, acrylic, bakelite), as well as metal and glass. In the present embodiment, as an example, it is structured of polycarbonate of a thickness of 3 mm.

As shown in FIG. 4, the second chamber 218 and the third chamber 220 are connected from the first waste ink flow paths 214 in that order by a second waste ink flow path 222 and an air intake flow path 224. The waste ink of the first chamber 212 is either fed-back to the main tank 68 (or the sub tank 34) as described above, or an opening/closing valve 228 provided at the second waste ink flow path 222 is opened and the waste ink is fed to the second chamber 218, and thereafter, a valve 230 for discharge is opened and the waste ink can be discharged to the exterior from a discharge path 232.

In the same way as the first chamber 212, it suffices for volume of the second chamber 218 to be of an extent such that the suctioned ink can be accumulated therein. In particular, in a structure in which plural first chambers 212 are made to correspond to a single second chamber 218, the second chamber 218 must have a volume which is greater than that of the first chambers 212. Specifically, the second chamber 218 preferably has a volume which is greater than or equal to about five times the total ink amount which is suctioned by one suction operation. In the present embodiment, one second chamber 218 is made to correspond to four of the first chambers 212, and the amount of ink which is suctioned one time is 96 ml. Thus, the volume of the second chamber 218 is made to be 1 liter, such that a sufficient volume of the second chamber 218 is ensured.

In the same way as the first chamber 212, it suffices for the material structuring the second chamber 218 to have sufficient rigidity to the extent that the second chamber 218 does not collapse inadvertently, and the second chamber 218 may have appropriate elasticity, provided that it is reversible to the extent that it does not collapse under the necessary negative pressure. Further, the material structuring the second chamber 218 must be a material which is ink resistant and corrosion resistant, and coating for repelling ink may be carried out on the interior thereof. Specific examples of the material are molded bodies of the various resin materials given as examples of the materials of the small chambers 66 and the first chamber 212, and plastic materials, as well as metal and glass. In the present embodiment, as an example, the second chamber 218 is formed by polycarbonate of a thickness of 3 mm.

Materials which can be used for the tubes of the main supply path 72, the main feedback path 74, the ink supply path 35, the ink circulating path 36, and the like can be used as the material of the discharge path 232 for discharging the ink within the second chamber 218. However, because there is the possibility that the ink within the discharge path 232 will coagulate due to increasing of viscosity or the like, it is preferable to form the discharge path 232 to have an inner diameter which is larger than that of the above-described tubes in order to maintain a smooth flow of ink.

An electromagnetic solenoid valve having the same structure as that illustrated in FIGS. 14A, 14B is preferably used as the valve 230 for discharge which is provided at the discharge path 232. Further, a manual cock or the like may be used (e.g., the valve 230 for discharge may be structured such that the valve mechanism shown in FIGS. 13A and 13B is operated manually). In particular, when a structure is used in which it waits to discharge the ink until a predetermined amount of ink or more has accumulated within the second chamber 218, the structure can be simplified by using a manual cock. In a structure in which the discharge path 232 is opened manually, it is preferable to mount a sensor, which senses that the second chamber 218 is full of ink, within the second chamber 218, and to notify the user of the full state by a lamp, an alarm, a message, or the like, so as to urge the user to discharge the ink.

A pump, for example, may be used to discharge the ink from the second chamber 218. Or, the discharge path 232 may be connected to the bottom portion of the second chamber 218 and the ink discharged by gravity. Further, a structure may be used in which the air intake pump 236 is driven reversely so as to make the interior of the second chamber 218 be positive pressure, and only the valve 230 for discharge is opened all at once. In the structure utilizing gravity and the structure utilizing positive pressure within the second chamber 218, there is no need for a pump for discharge.

The air intake pump 236 is connected to the third chamber 220 via an air intake pipe 234. By opening and closing an air intake valve 238, negative pressure is generated in the third chamber 220. This negative pressure is applied to the receiving members 82 via the second chamber 218 and the first chamber 212.

A pressure sensor 260 is set within the third chamber 220, and can detect the degree of the negative pressure at the time when air is taken in by the air intake pump 236. When the pressure sensor 260 is provided within the third chamber 220 in this way and the ink within the second chamber 218 is not allowed to reach the third chamber 220, the adhesion of ink to the pressure sensor 260 can be prevented. In particular, as can be understood from FIG. 4 as well, disposing the portion of the air intake flow path 224, which portion is connected to the second chamber 218, at the top portion of the second chamber 218 is preferable because it is difficult for the ink within the second chamber 218 to flow into the air intake flow path 224. Moreover, it is further preferable to provide, at the air intake flow path 224, filters 262 which do not allow the passage of ink and only allow the passage of air. The positions of the filters 262 are not particularly limited, and the filters 262 may be provided at the portion connected to the second chamber 218 and the portion connected to the third chamber 220. As shown in FIG. 4, it is preferable to mount the filters 262 to the both ends of the air intake flow path 224. Or, the air intake flow path 224 itself may function as a filter. A filter which is air permeable to the extent that it does not slow the time for the pressure to reach the second chamber 218 from the third chamber 220 is particularly preferably used as the filter 262. In place of the filter 262 (or together therewith), a blocking member (e.g., a blocking plate or the like) which blocks the flow of ink to the air intake flow path 224 may be provided.

Information regarding the negative pressure which is detected by the pressure sensor 260 is sent to a maintenance controller 244. The interior of the third chamber 220 is opened to the atmosphere by an atmosphere opening valve 264 provided at the third chamber 220, such that the unneeded negative pressure (or positive pressure, depending on the case) therein is released.

The volume of the third chamber 220 is not particularly limited provided that it is of an extent such that the pressure sensor 260 can be set therein. For example, the volume of the third chamber 220 may be the same level as that of the first chamber 212 or the same level as that of the second chamber 218, or may be a volume therebetween.

It suffices for the air intake pump 236 to generate negative pressure to the extent that ink can be suctioned from the recording head 44 via the capping portions 80. The negative pressure which is needed at this time is determined in accordance with the diameter of the nozzle, the number of nozzles which are the objects of suctioning by the air intake pump 236, the physical properties of the ink which is used, the rigidity of the materials used from the nozzles to the air intake pump 236, and the like. In the present embodiment, a pump is used which generates a maximum negative pressure of −30 kPa or more, and preferably −50 kPa or more, and more preferably −100 kPa or more. Examples of the type of pump which can be used are a rotating type pump, a centrifugal pump, a mixed flow pump, an axial flow pump, a rotary pump, a gear pump, a reciprocating pump, a diaphragm pump, a piston pump, an air pump, a rotary tube pump, an electromagnetic pump, a motor pump, and the like. Thereamong, a dry-type diaphragm vacuum pump, with which no measures with respect to oil or exhaust must be taken, is ideal from the standpoints of environmental suitability and maintenance.

Atmosphere opening valves not shown in the drawings are provided at the first chamber 212 and the second chamber 218, and can open the interiors of these chambers to the atmosphere.

A discharge path opening/closing valve 216, the opening/closing valve 228, the valve 230 for discharge, the air intake valve 238, and the atmosphere opening valves 240, 242 are all controlled by the maintenance controller 244.

In the present embodiment which is structured in this way, in order to suction ink from the recording head 44, the interiors of the small chambers 66 are made to be negative pressure in the state in which the capping portions 80 are fit tightly to the unit heads 40, and this negative pressure is applied to the concave portions 82A of the receiving members 82 by opening the capping portion side opening/closing valves 94. In this way, the inks within the unit heads 40 can be suctioned. Because the capping portions 80 (the receiving members 82) and the small chambers 66 are disposed so as to oppose the respective unit heads 40, the negative pressure is controlled per unit head 40, and the inks can be suctioned individually. For example, by suctioning ink only from a specific unit head 40 requiring ink suction and not suctioning ink from the other unit heads 40, the amount of ink which is consumed accompanying the suction operation can be made to be small. Because the capping portions 80 are disposed so as to face the unit heads 40 in advance, the suction of ink from the respective unit heads 40 can be carried out in a short period of time without moving the capping portions 80 (only raising the capping portions 80).

Figure 5:
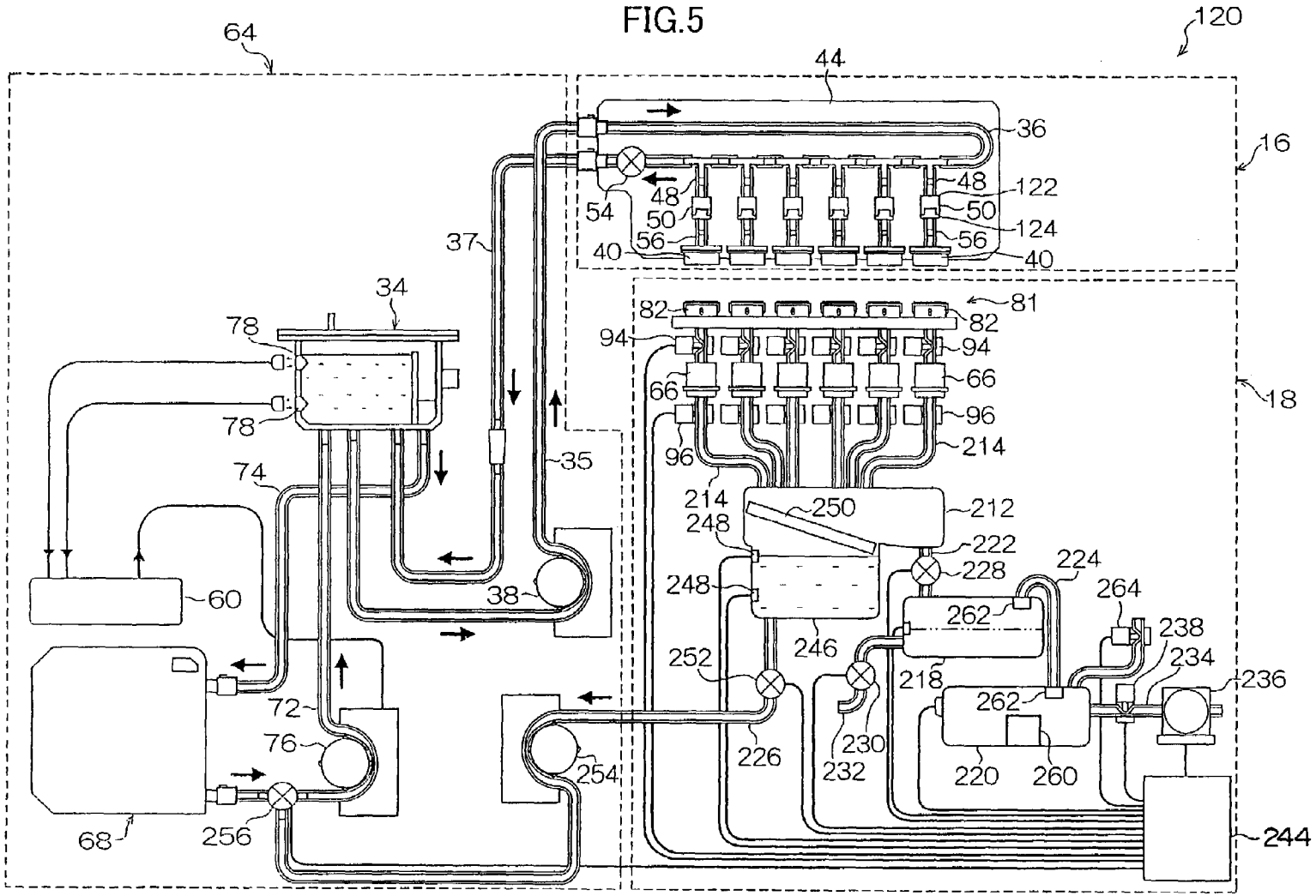
FIG. 5 is a schematic structural diagram showing a recording device of a second embodiment.

An inkjet recording device 120 of a second embodiment of the present invention is shown in FIG. 5.

In this inkjet recording device 120, the overall structure is the same as that of the inkjet recording device 10 of the first embodiment, but a feedback accumulating portion 246 is formed at the first chamber 212 as shown in FIG. 5. The feedback accumulating portion 246 is formed by a portion of the floor portion of the first chamber 212 protruding downwardly. One end of an ink feedback path 226 is connected to the floor portion of the feedback accumulating portion 246, and one end of the second waste ink flow path 222 is connected to a location of the first chamber 212 where the feedback accumulating portion 246 is not formed. With this structure, even if ink accumulates within the first chamber 212, this ink (the ink which is to be fed-back) does not flow into the second waste ink flow path 222, and does not affect the ink suction operation.

Liquid level sensors 248 are mounted to the feedback accumulating portion 246, and sense the liquid level of the ink, and transmit this information to the maintenance controller 244. It is preferable to provide the liquid level sensors 248 at two (or more) places such that both the state of the feedback accumulating portion 246 being filled with ink and the state in which discharge has been completed (or a state in which a predetermined amount or more has been discharged) can be sensed. Further, a structure is possible in which ink is discharged from the feedback accumulating portion 246 at predetermined times or under a given condition periodically, and no liquid level sensor 248 is provided.

Mounting a filter 250 to the interior of the first chamber 212 above the feedback accumulating portion 246 is preferable because foreign matter (dirt, aggregates of thickened ink, and the like) does not become mixed in with the ink accumulated in the feedback accumulating portion 246 (the ink to be reused). With regard to the position of the filter 250, setting the filter 250 beneath all of the first waste ink flow paths 214 is preferable because all of the ink fed into the first chamber 212 from the small chambers 66 flows once into the filter 250. Disposing the filter 250 to be inclined downwardly toward the second waste ink flow path 222 is preferable because the components which are not filtered-out by the filter 250 can be efficiently led to the second waste ink flow path 222 and the components which can be reused are efficiently sent into the feedback accumulating portion 246. Further, a valve may be provided between the first chamber 212 and the second chamber 218 so that the ink fed from the small chambers 66 into the first chamber 212 is not directly fed into the second chamber 218. With such structures, the ink can be reused with even less waste.

The material of the filter 250 is not particularly limited provided that it is ink resistant. Examples include metal stainless filters, resin filters (as one example, a nylon mesh filter), and the like. Thereamong, a metal mesh filter which can withstand frequent changes between negative pressure and atmospheric pressure is ideal. The size of the mesh of the filter 250 can be appropriately selected in accordance with the particle diameter of the coloring material of and the viscosity of the ink which is used, the suctioned amount at the time of vacuuming, and the like, but an average hole diameter of 0.5 μm or more to 30 μm or less is preferable.

The ink feedback path 226, one end of which is connected to the feedback accumulating portion 246, is connected to a switching valve 256 for the feedback path of the main supply path 72, via an airtight valve 252 for the feedback path and a pump 254 for the feedback path. In the state in which the airtight valve 252 for the feedback path is opened and the switching valve 256 for the feedback path is set at the main tank side, the pump 254 for the feedback path is driven, and the ink of the feedback accumulating portion 246 can be fed-back to the main tank 68. Note that, at the time of suctioning the ink from the unit heads 40, the airtight valve 252 for the feedback path is closed such that the airtight state of the interior of the first chamber 212 is maintained. Accordingly, it is fine to carry out the ink feedback operation at times when suctioning is not being carried out.

The pump 254 for the feedback path is not limited provided that it can feed back the ink of the feedback accumulating portion 246 to the main tank 68, but the rotary pump shown in FIG. 4 as well as preferable. Note that, by reversely rotating the air intake pump 236 and setting the interior of the first chamber 212 in a positive pressure state and opening only the airtight valve 252 for the feedback path all at once, the ink can be fed-back to the main tank 68 by utilizing the positive pressure within the first chamber 212. In this case, the pump 254 for the feedback path is not needed.

Next, the process of suctioning ink from the unit heads 40 in the respective embodiments of the present invention will be described. In the present embodiments, there are the following three cases of ink suctioning:

1. a case in which ink is suctioned from all of the unit heads 40;
2. a case in which ink is suctioned from a specific row of the unit heads 40 (a case in which ink is suctioned per specific color or per specific recording head array 42A, 42B, which is effective, for example, when replacing the ink, when carrying out maintenance operations on the main tank 68 or the sub tank 34, when replacing the recording head array, or the like); and
3. a case in which ink is suctioned from only one of the unit heads 40 (a case in which clogging or the like occurs at only a specific unit head 40, or the like).

Hereinafter, "1. a case in which ink is suctioned from all of the unit heads 40" will be described as an example.

Figure 16:
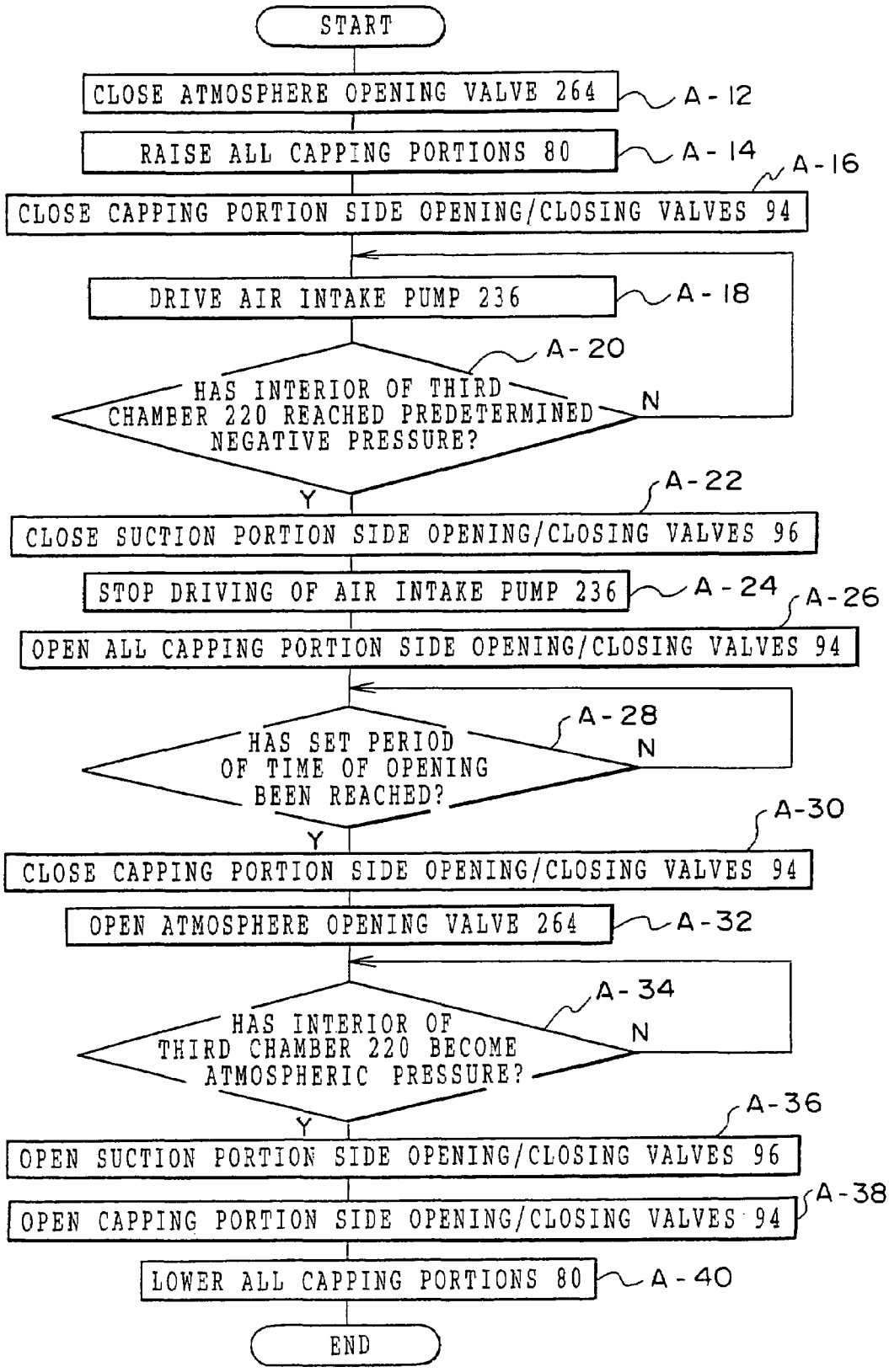
FIG. 16 is a flowchart showing an example of an ink suctioning sequence in the recording device of the present invention.

The basic operation of suctioning ink at the inkjet recording device 120 having the structure shown in FIG. 5 is shown in the flowchart of FIG. 16. In the inkjet recording device 120, in an usual state, the opening/closing valve 228 is opened, and the airtight valve 252 for the feedback path and the valve 230 for discharge are closed.

When ink is to be suctioned, first, in step A-12, the atmosphere opening valve 264 is closed. Then, in step A-14, all of the capping portions 80 are raised (are fit tightly to the unit heads 40). Here, in step A-16, when the capping portion side opening/closing valves 94 are closed, an airtight system which are from the air intake pump 236 via the third chamber 220, the second chamber 218, and the first chamber 212 to the small chambers 66, is formed. When the air intake pump 236 is driven in step A-18, the pressure of this airtight system is gradually reduced, and therefore, the degree of this negative pressure is sensed by using the pressure sensor 260. In step A-20, it is judged whether or not the interior of the third chamber 220 has reached a predetermined negative pressure. If the predetermined negative pressure has not been reached, the routine returns to step A-18 and the air intake pump 236 continues to be driven. If reached, in step A-22, the suction portion side opening/closing valves 96 are closed, and in step A-24, driving of the air intake pump 236 is stopped. In this way, the interiors of all of the small chambers 66 are a predetermined negative pressure.

In this state, in step A-26, all of the capping portion side opening/closing valves 94 are opened. The negative pressures within the small chambers 66 act on the capping portions 80 (the concave portions 82A of the receiving members 82), and ink is suctioned from the corresponding unit heads 40 and temporarily accumulated in the small chambers 66. In step A-28, it is judged whether or not the time over which the capping portion side opening/closing valves 94 have been open has reached a period of time of opening which is set in advance. If this time has not been reached, the capping portion side opening/closing valves 94 are maintained in their open states until the set period of time of opening is reached. When this time is reached, in step A-30, the capping portion side opening/closing valves 94 are closed. In step A-32, the atmosphere opening valve 264 is opened, and the interior of the third chamber 220 is opened to the atmosphere. In step A-34, a judgment is made by the pressure sensor 260 as to whether or not the interior of the third chamber 220 has become atmospheric pressure. If it has not, the system stands-by until atmospheric pressure is reached. When the interior of the third chamber 220 reaches atmospheric pressure, in step A-36, the suction portion side opening/closing valves 96 are opened, and further, the capping portion side opening/closing valves 94 are opened. Here, when all of the capping portions 80 are lowered in step A-40, the interiors of the concave portions 82A of the receiving members 82 are opened to the atmosphere, the interiors of the small chambers 66 also are opened to the atmosphere, and the ink within the small chambers 66 flows down into the first chamber 212. Ink can be suctioned from all of the unit heads 40 by the above-described operations.

Note that in aforementioned "2. a case in which ink is suctioned from a specific row of the unit heads 40" and "3. a case in which ink is suctioned from only one of the unit heads 40", at specific steps, it suffices for predetermined operations to be carried out only at the capping portion(s) 80 and the capping portion side opening/closing valve(s) 94 corresponding to the unit head(s) 40 for which ink suctioning is to be carried out. For example, in step A-14, only the corresponding capping portion(s) 80 is/are raised, and in step A-26, only the corresponding capping portion side opening/closing/valve(s) 94 is/are opened, and the like.

Further, in above "3. a case in which ink is suctioned from only one of the unit heads 40", as a preliminary process therefor, it is preferable to learn, by a clogged head determining portion, at which of the unit head 40 clogging has occurred. Examples of the clogged head determining portion are a structure in which a specific clogged head confirmation pattern is printed and the user inputs the results of printing to the maintenance controller 244, and a structure in which results of printing are read by a reading device (e.g., an optical reading device such as a scanner or the like) and are inputted to the maintenance controller 244. Further, a discharge state sensing portion which senses the discharged states of the ink drops (e.g., an ink drop sensing portion by using laser light, or the like) may be newly provided, and the unit head 40 at which clogging has arisen can be known from the discharge states which are directly detected.

Figure 17A:
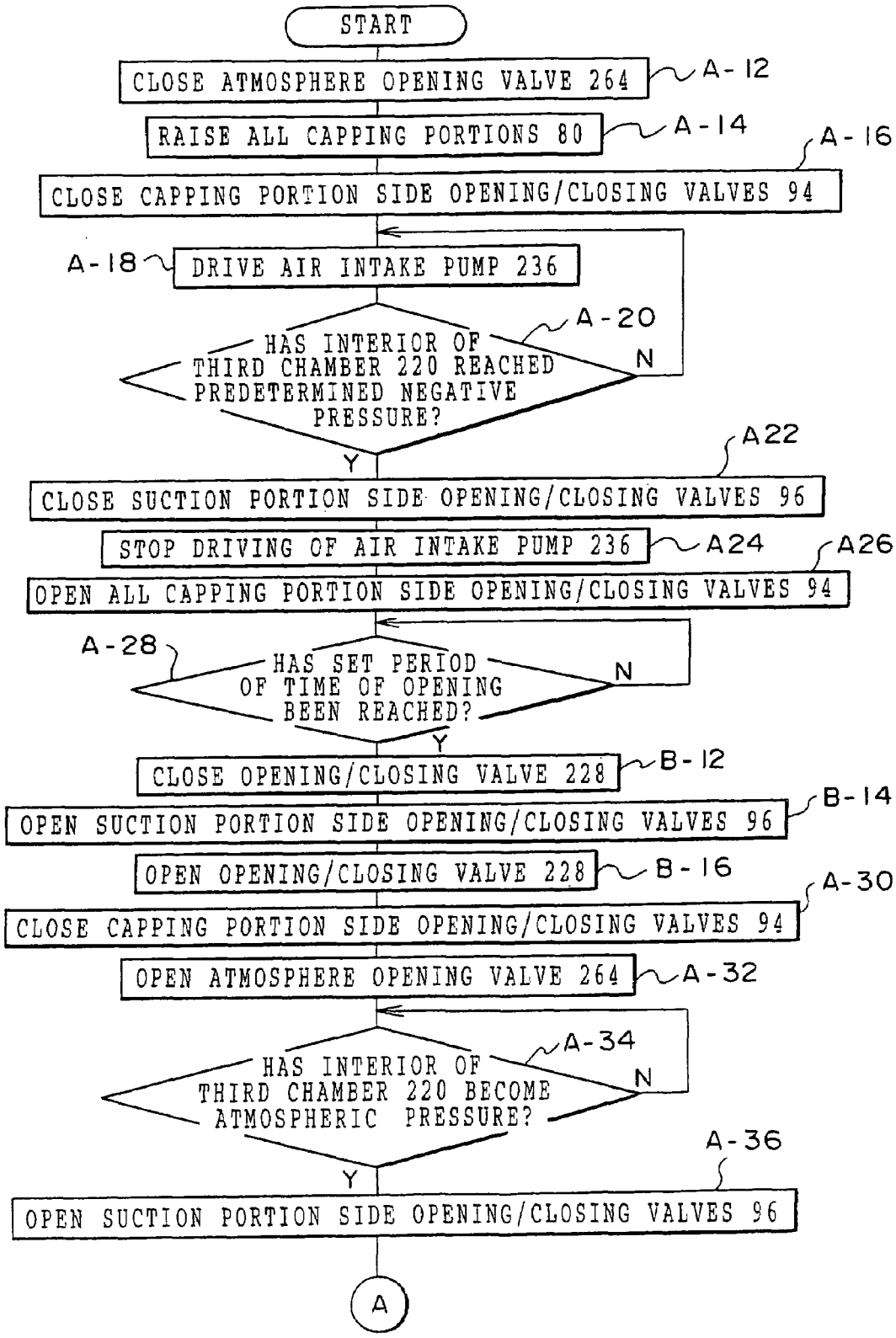
FIGS. 17A and 17B are flowcharts showing an example of the ink suctioning sequence in the recording device of the present invention.
Figure 17B:
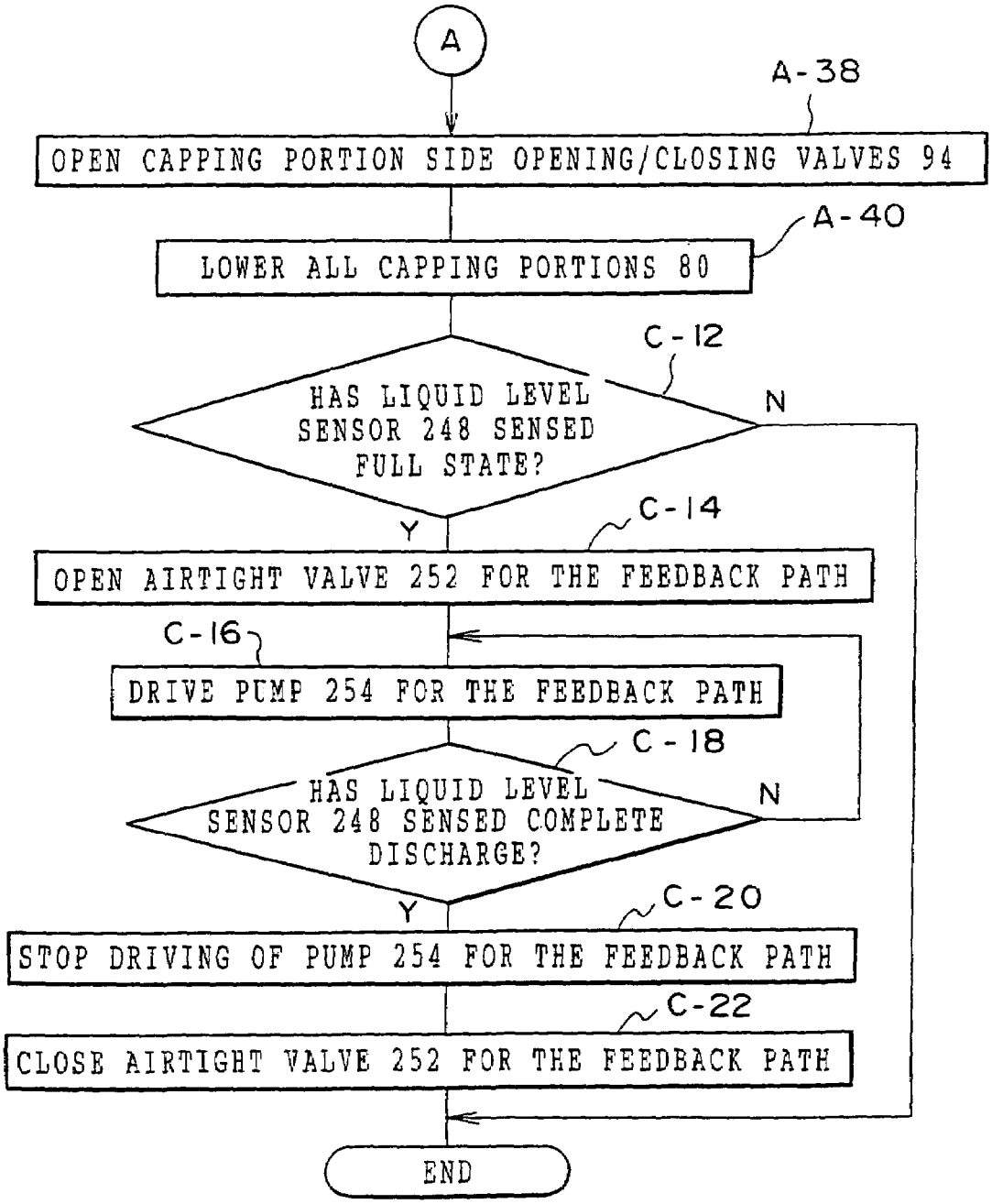

An ink suctioning sequence which can be applied to the inkjet recording device 120 of the second embodiment is shown in FIGS. 17A and 17B. In this sequence, operations are added to the basic sequence shown in FIG. 16. In FIGS. 17A and 17B, steps which are the same as those of FIG. 16 are denoted by the same step numbers, and detailed description thereof is omitted.

In the sequence shown in FIGS. 17A and 17B, when it is judged, in step A-28, that the time over which the capping portion side opening/closing valves 94 have been open has reached the period of time of opening set in advance, in step B-12, the opening/closing valve 228 of the second waste ink flow path 222 is closed. In this way, some of the negative pressure remains in the portion from the suction portion side opening/closing valves 96 to the opening/closing valve 228, i.e., within the first chamber 212. Here, when the suction portion side opening/closing valves 96 are opened in step B-14, due to the negative pressure within the first chamber 212, the ink within the small chambers 66 is led into the first chamber 212. Thereafter, in step B-16, the opening/closing valve 228 is opened and the ink within the first chamber 212 can be fed out to the second chamber 218, and the routine moves on to step A-30.

In this way, in the sequence shown in FIGS. 17A and 17B, due to steps B-12 through B-16 which are added between steps A-28 and A-30, negative pressure is applied to the interior of the first chamber 212, and by utilizing this negative pressure, the ink within the small chambers 66 can be led into the first chamber 212.

In the sequence shown in FIGS. 17A and 17B, after step A-40, in step C-12, the state of fullness is sensed by the liquid level sensor 248 of the feedback accumulating portion 246, and if it is not full, processing ends as is. However, if it is full, in step C-14, the airtight valve 252 for the feedback path is opened. Then, in step C-16, when the pump 254 for the feedback path is driven, the ink in the feedback accumulating portion 246 is fed-back to the main tank 68. (Note that, by switching the switching valve 256 for the feedback path and driving the main pump 76, the ink may be send to the sub tank 34 without being returned to the main tank 68.) Because the amount of ink within the feedback accumulating portion 246 gradually decreases, in step C-18, the liquid level sensor 248 senses whether or not the ink within the feedback accumulating portion 246 has been discharged out by more than a predetermined value. If not all of the ink has been discharged out, the routine return to step C-16, and the pump 254 for the feedback path continues to be driven. If all of the ink has been discharged out, in step C-20, driving of the pump 254 for the feedback path is stopped, and in step C-22, the airtight valve 252 for the feedback path is closed.

Accordingly, in the sequence of FIGS. 17A and 17B, the ink of the feedback accumulating portion 246 can be fed-back and reused.

Next, the present invention will be described in even further detail by the use of Examples. Of course, the present invention is not limited to the following Examples.

EXAMPLE 1

In Example 1, suctioning of ink is carried out in accordance with the sequence shown in FIG. 16, by using the inkjet recording device 10 having substantially the same structure as that shown in FIG. 4 (i.e., an inkjet recording device in which the feedback accumulating portion 246 is not formed at the first chamber 212, and the ink feedback path 226, the airtight valve 252 for the feedback path, the pump 254 for the feedback path, and the like are not provided). There are eight of the unit heads 40.

The specific structure of this inkjet recording device is as follows.

first waste ink flow paths 214:
- silicon tubes having an inner diameter of 3 mm and an outer diameter of 4 mm second waste ink path 222, air intake flow path 224, air intake tube 234:
- Tygon tubes having an inner diameter of 4 mm and an outer diameter of 8 mm small chambers 66:
- hollow cylindrical tubes made of polyacetal and having a cross-sectional diameter of 2 cm, an internal volume of 4 ml, and a wall thickness of 2 mm amount of suctioned ink set for small chamber 66:
- 2 ml capping portion side opening/closing valves 94, suction portion side opening/closing valves 96:
- electromagnetic solenoid valves air intake pump 236:
- diaphragm type vacuum pump ULVAC DA-40S first chambers 212:
- polycarbonate of a thickness of 3 mm, 0.5 liters×8 second chamber 218:
- polycarbonate of a thickness of 3 mm, 1 liter×1 third chamber 220:
- polycarbonate of a thickness of 3 mm, 1 liter×1 negative pressure set for interior of third chamber 220:
- 50 kPa set period of time of opening of capping portion side opening/closing valves 94 during sequence:
- 2 seconds In the above structure, when a suction start signal is outputted from the maintenance controller 244, the sequence shown in FIG. 16 is executed, and ink can be suctioned from all of the unit heads 40.

EXAMPLE 2

The specific structure of the inkjet recording device is the same as that in Example 1, but before ink is suctioned, a clogged nozzle confirmation pattern is printed, and on the basis of the results thereof, pattern output information (clogged nozzle information) is inputted to the maintenance controller 244. Then, in the sequence of FIG. 16, by controlling only specific capping portion side opening/closing valves 94 and suction portion side opening/closing valves 96, the clogging can be eliminated when only those caps including the clogged nozzles are suctioned.

EXAMPLE 3

In Example 3, ink suctioning is carried out in accordance with the sequence shown in FIGS. 17A and 17B, by using the inkjet recording device shown in FIG. 5. (Accordingly, the feedback accumulating portion 246 is formed at the first chamber 212, and the ink feedback path 226, the airtight valve 252 for the feedback path, the pump 254 for the feedback path, and the like are provided. The opening/closing valve 228 also is provided.)

The specific structure of this inkjet recording device is the same as that of Example 1, except for the following.

ink feedback path 226:
- Tygon tube of an inner diameter of 4 mm and an outer diameter of 8 mm airtight valve 252 for the feedback path, opening/closing valve 228:
- electromagnetic solenoid valves pump 254 for the feedback path:
- rotary tube pump first chamber 212:
- polycarbonate of a thickness of 3 mm and having a total capacity of 0.6 liters feedback accumulating portion 246:
- capacity of 0.3 liters, formed at a position within the first chamber 212 which position is apart from the waste ink flow path 222 filter 250:
- mesh filter having an average hole diameter of 10 μm, disposed at an incline above the feedback accumulating portion 246 so as to segregate the feedback accumulating portion 246 from the first waste ink flow paths 214 and the second waste ink flow path 222 liquid level sensors 248:
- optical type ink liquid level sensors disposed at the upper portion and the lower portion of the feedback accumulating portion 246, respectively In the above-described structure as well, the sequence shown in FIGS. 17A and 17B is executed, and ink can be suctioned from all of the unit heads 40.

Then, when the liquid level sensor 248 senses that the feedback accumulating portion 246 has become full of ink, at the next time that printing is not being carried out and suction is not being carried out, the airtight valve 252 for the feedback path is opened, the pump 254 for the feedback path is driven, and the ink is fed-back to the main tank 68. When the liquid level sensor 248 senses that the liquid level of the ink in the feedback accumulating portion 246 has fallen to a predetermined value or less and that discharge of a predetermined amount or more has been completed, driving of the pump 254 for the feedback path is stopped, and the airtight valve 252 for the feedback path is closed (see steps C-12 through C-22 in FIG. 17B). In this way, it become possible to carry out the usual recording operations.

Owing to the ink feedback path, 83% of the ink suctioned in the present example can be reused.

EXAMPLE 4

In Example 4, an inkjet recording device having the same structure as that in Example 1 is used. Ink is not fed-back from the feedback accumulating portion 246 to the main tank 68 or the like, but is discharged from the second chamber 218 via the discharge path 232 to the exterior and is recovered thereat. The specific structure is:

discharge path 232:

Tygon tube having an inner diameter of 4 mm and an outer diameter of 8 mm valve 230 for discharge:

electromagnetic solenoid valve

Other Structures are the Same as in Example 1.

After the ink is suctioned from the unit heads 40, the ink is fed from the first chamber 212 to the large chamber 220. A liquid level sensor provided within the second chamber 220 senses that the ink has accumulated, and when notification thereof is given, at the next time that printing is not being carried out and suction is not being carried out, the valve 230 for discharge is opened and the ink within the second chamber 220 is discharged out. This ink is recovered in a recovery tray (or a recovery tank or the like; it suffices to utilize a container which enables recovery). After the valve 230 for discharge is left open for a predetermined period of time, the valve 230 for discharge is closed, and it become possible to carry out the usual recording operations.

In the present invention, the suction portion may be directly connected to the small chambers, and the interiors of the small chambers may be suctioned directly. However, a structure may be used in which the maintenance device has a first air chamber interposed between the plurality of small chambers and the suction portion, and the suction portion suctions the interiors of the small chambers via the first air chamber. In this structure, by applying the negative pressure, which is applied to the interior of the first air chamber, to the corresponding plurality of small chambers, dispersion among the negative pressures of the respective small chambers can be made to be small.

The first air chamber can temporarily accumulate the suctioned ink. In this case, in a maintenance device of a recording device which can record in plural colors for example, there is no problem if the plural colors are mixed together within the first air chamber. However, if a plurality of the first air chambers are provided independently at least for each color of the liquid drops, the inks in the first air chambers can be reused for image recording. Further, if it is structured to have ink feedback paths which feed back inks of the first air chambers to ink tanks in which inks to be discharged from the unit heads are accumulated in advance, reuse of the inks within the first air chambers is made easy.

A structure may be used in which the maintenance device has a second air chamber interposed between the plurality of first air chambers and the suction portion, and the suction portion suctions the interiors of the small chambers via the second air chamber and the first air chambers. In this structure, the suctioned ink can be temporarily accumulated in the second air chamber. A single second air chamber may be provided in common for all of the first air chambers, or a plurality of the second air chambers may be provided. In any case, if the maintenance device has a recovery portion which recovers ink of the common second air chamber, the suctioned ink can be recovered.

Moreover, a structure may be used in which the maintenance device has a third air chamber interposed between the second air chamber and the suction portion, and the suction portion suctions the interiors of the small chambers via the third air chamber, the second air chamber and the first air chambers. In this structure, the negative pressure of the suction portion is applied to the small chambers via the third air chamber, the second air chamber, and the first air chambers. However, the suctioned ink is not accumulated in the third air chamber, and the ink in the second air chamber does not inadvertently enter into the third air chamber. Accordingly, even if another member (e.g., a pressure sensor) or the like is provided within the third air chamber, this other member is not affected by the ink. Further, the suction portion which is connected to the third air chamber also is not affected by the ink.

The recording device of the second aspect of the present invention may have a recording head structured by a plurality of unit heads which can discharge liquid drops onto a recording medium; and a maintenance device which carries out maintenance on the unit heads and has any of the above-described features.

Because the maintenance device of the first aspect is provided, if only the unit heads at which clogging has arisen are suctioned, less ink is consumed at the time of suctioning the ink, and the ink can be suctioned in a short period of time. Further, by structuring this recording device to have a recording head in which the plural unit heads are plurally arranged to sandwich a recording medium conveying path, an image can be recorded by liquid drops being discharged from the plural unit heads, which structure the recording head, onto the recording medium being conveyed on the recording medium conveying path.

Because the present invention has the above described structure, ink can be suctioned in a short period of time with less ink being consumed at the time of suctioning.

What is claimed is:

1. A maintenance device comprising:

a plurality of capping portions disposed to face a plurality of unit heads which can discharge liquid drops onto a recording medium;

a plurality of small chambers communicating with the plurality of capping portions, respectively;

a suction portion suctioning interiors of the small chambers;

a plurality of valve mechanisms independently controlling airtight states of the interiors of the small chambers; and a first air chamber interposed between the plurality of small chambers and the suction portion, wherein the suction portion suctions the interiors of the small chambers via the first air chamber.

2. The maintenance device of claim 1, wherein a plurality of the first air chambers are provided independently at least for each color of the liquid drops.

3. The maintenance device of claim 2, further comprising an ink feedback path which feeds back ink of the first air chamber to an ink tank in which ink to be discharged from the unit heads is accumulated in advance.

4. The maintenance device of claim 2, further comprising a second air chamber interposed between the plurality of first air chambers and the suction portion, wherein the suction portion suctions the interiors of the small chambers via the second air chamber and the first air chambers.

5. The maintenance device of claim 4, further comprising a recovery portion which recovers ink of the second air chamber.

6. The maintenance device of claim 4, further comprising a third air chamber interposed between the second air chamber and the suction portion, wherein the suction portion suctions the interiors of the small chambers via the third air chamber, the second air chamber and the first air chambers.

7. A recording device comprising:

a recording head structured by a plurality of unit heads which can discharge liquid drops onto a recording medium; and a maintenance device carrying out maintenance on the unit heads, and having:

a plurality of capping portions disposed to face the plurality of unit heads;

a plurality of small chambers communicating with the plurality of capping portions, respectively;

a suction portion suctioning interiors of the small chambers;

a plurality of valve mechanisms independently controlling airtight states of the interiors of the small chambers; and a recovery portion, connected between the small chambers and the suction portion, that recovers the suctioned liquid drops.

8. The recording device of claim 7, wherein, in the recording head, the plurality of the unit heads are plurally arranged in a conveying direction of a recording medium.

9. A maintenance device comprising:

a plurality of capping portions disposed to face a plurality of unit heads which can discharge liquid drops onto a recording medium, the capping portions suctioning liquid drops from the unit heads;

a plurality of small chambers, communicating with the plurality of capping portions, respectively, that apply negative pressure to the capping portions such that the liquid drops can be suctioned from the unit heads;

a suction portion suctioning interiors of the small chambers;

plurality of valve mechanisms independently controlling airtight states of the interiors of the small chambers; and a recovery portion, connected between the small chambers and the suction portion, that recovers the suctioned liquid drops.

* * * * *